United States Patent [19]

Foster et al.

[11] Patent Number: 4,548,400

[45] Date of Patent: Oct. 22, 1985

[54] INSERTER GAUGING SYSTEM

[75] Inventors: Dean H. Foster, Stratford; Robert E. Mersereau, Westport; Harold Silverman, Norwalk, all of Conn.

[73] Assignee: Pitney Bowes, Inc., Stamford, Conn.

[21] Appl. No.: 529,188

[22] Filed: Sep. 2, 1983

Related U.S. Application Data

[62] Division of Ser. No. 210,464, Nov. 26, 1980, Pat. No. 4,418,515.

[51] Int. Cl.[4] ..... B65H 9/00

[52] U.S. Cl. ..... 271/226; 53/266 A; 271/238; 271/255; 493/479

[58] Field of Search ..... 271/226, 238, 240, 263, 271/248, 250, 253-255, 171; 53/266 A; 493/478, 479; 33/174 PA, 174 PB

[56] References Cited

U.S. PATENT DOCUMENTS

| | | | |
|---|---|---|---|
| 3,592,464 | 7/1971 | Kanda | 271/223 |
| 3,804,402 | 4/1974 | Hottendorf | 271/171 |
| 4,077,181 | 3/1978 | Asner et al. | 53/266 A |
| 4,381,108 | 4/1983 | Newsome | 271/240 |

*Primary Examiner*—Bruce H. Stoner, Jr.
*Assistant Examiner*—John A. Carroll
*Attorney, Agent, or Firm*—Donald P. Walker; William D. Soltow, Jr.; Albert W. Scribner

[57] ABSTRACT

A gauging system for an envelope inserter provides simplified set up procedures for adjustment of a set of enclosure pick-up station side guides, an envelope stop and coordinated adjustment of both a set of envelope station side guides and sets of stripper fingers. A panel at the face of the inserter includes a slot and a pointer for lengthwise insertion of an enclosure. The operator places a specimen enclosure against an index end of the slot and rotates a knob to frame the enclosure length between the index and the pointer. Rotation of the knob provides simultaneous movement of the pointer and adjustment of the enclosure side guides to correspond with the framed length. A further slot and pointer are provided for envelope widthwise insertion. Rotation of its knob for framing the envelope width simultaneously adjusts the envelope stop. A further slot and pointer are provided for lengthwise envelope insertion. Rotation of its knob for framing the envelope length adjusts both the side guides and the stripper fingers. The index end of the envelope length slot is displaced to compensate for a dwell in side guide movement and a coordinated retraction in stripper finger position.

12 Claims, 27 Drawing Figures

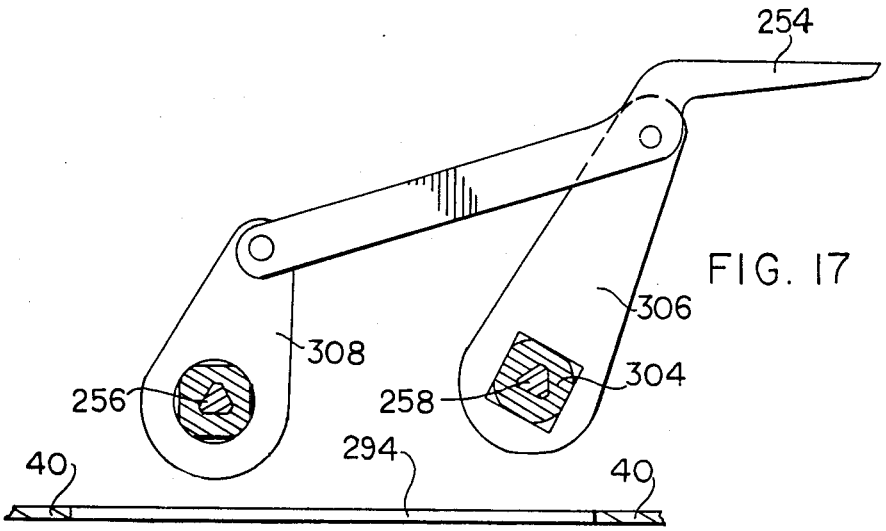
FIG. 17
FIG. 18
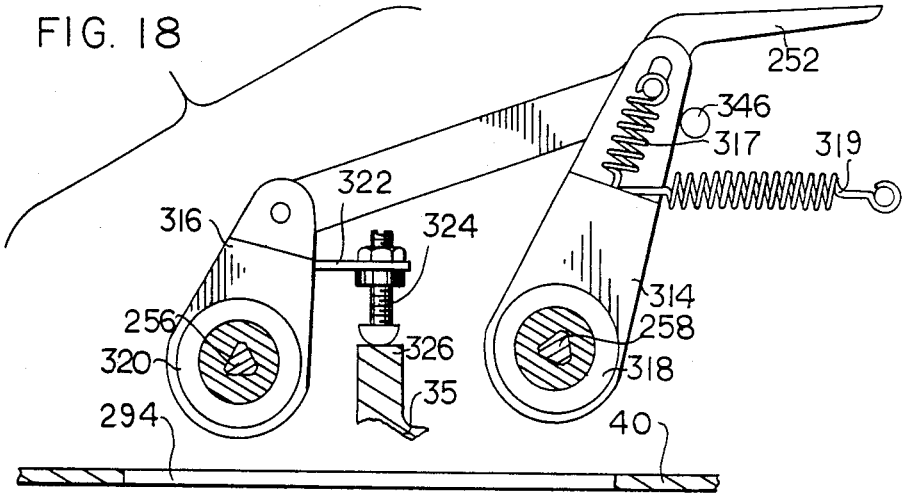
FIG. 19
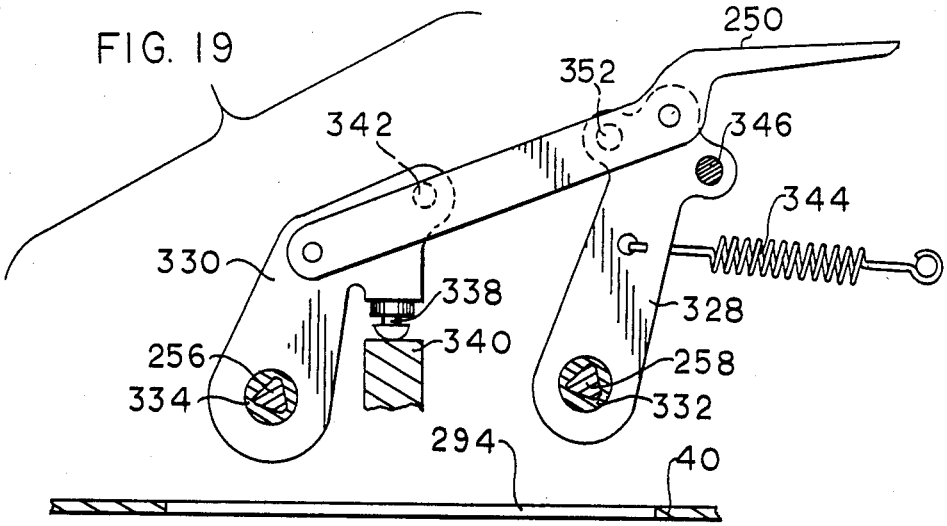

26
26
148
152
154
176
42
215
216
214
217
386
388
390
376
378
380
382
384
372
374
370
392
148
152
384
382
370
374
392
380

INSERTER GAUGING SYSTEM

This application is a division of Ser. No. 06/210,464 filed on Nov. 26, 1980 and now U.S. Pat. No. 4,418,515.

BACKGROUND OF THE INVENTION

1. Field of the Invention

This invention relates generally to inserters and more particularly a gauging system for simplified set up of an inserter to accommodate specific enclosure and envelope dimensions of a particular run.

2. Brief Description of the Prior Art

Inserters have played a significant role among the labor saving devices available to businesses which are engaged in the daily mailing of large numbers of pieces. Among the advantages of inserter usage has been the reduction in personnel required to process large quantities of outgoing mail. Further, mail room personnel have been relieved of the monotonous task of individually stuffing a seemingly insurmountable number of envelopes. Inserters have been particularly well adapted for use in the mailing of form letters and the like and have been employed for the insertion of personalized documents, e.g. computer generated checks, tab cards, etc. into window envelopes.

In U.S. Pat. No. 2,914,895 issued Dec. 1, 1959 to Samuel W. Martin and assigned to the assignee of the present invention, an envelope inserter having a ram blade with an enclosure pusher secured to the blade undersurface has been described. The ram blade was mounted for reciprocal movement along a horizontal plane. The pusher engaged an enclosure at an enclosure pick-up station and drove it into the envelope which was seated at an envelope station. In order to open the mouth of each successive envelope for reception of an enclosure and the ram blade, sets of stripper fingers were employed to enter the envelope mouth. The stripper fingers were released from a retracted position by the forward stroke of the ram.

The inserter disclosed in the Martin patent, supra, included many features typical of the Pitney Bowes series 3300 inserters. In the Pitney Bowes Model 3320 Insertamate inserter which employed a ram mechanism similar to that of the Martin patent, a modified enclosure feeder assembly and an envelope feeder assembly were employed. The envelope feeder assembly carried an envelope flapper which was operable to automatically open the flaps of successive envelopes with the feeder assembly delivering envelopes to an envelope station dwell position adjustably controlled by a pair of side guides and a releasable envelope stop gate. Side guides were also provided at the enclosure pick-up station in a manner substantially as disclosed in the Martin patent.

It should be appreciated that before an initial run of a particular size enclosure and/or envelope, the inserter had to be set up to feed and transport enclosures and envelopes. The set up procedure with regard to the Model 3320 inserter included adjustment of the enclosure pick-up station side guides which were mounted to a pair of spaced parallel decks at the pick-up station. The operator was first required to measure and note the length of a specimen enclosure. Retaining screws on each side guide were then loosened and the guides were slid to a position slightly oversized from the noted measurement position utilizing index markings on the decks and side guides.

Thereafter, the inserter motor was turned on and an enclosure fed to the pick-up station while the operator was holding a motor driven hand wheel to prevent the initiation of a ram stroke. The motor was turned off after the enclosure was seated at the pick-up station. The operator was then required to reset each of the side guides to accommodate the enclosure seated at the pick-up station. It was imperative that both side guides were equidistantly spaced from the center of the travel path. It is worthy to note that the operator was required to reach to the rear of the inserter for adjustment of the pick-up station side guide spaced from the face of the inserter.

With regard to envelopes, the set up procedure included adjustment of the envelope stop gate at the envelope station. The stop gate was mounted beneath a cover which was journalled to a shaft extending between a pair of envelope feeder assembly frames. A thumb screw projected upwardly through a slot in the cover. The cover included an index of typical envelope size number markings. The thumb screw was loosened and the gate slid relative to the cover until a pointer which projected through the track from the gate was aligned with an appropriate marker. The markers were not exact, however, and only served as a starting point for further adjustments. This procedure required the operator to have knowledge of the envelope size number for the initial setting and was dependent upon refined adjustments based upon trial and error as well as experience.

For adjustment of the envelope side guides, scale dimensions were provided on an envelope deck and the operator was required to reach behind the envelope feeder to make individual adjustments of each side guide by loosening a thumb screw and moving the guide.

The complicated set up procedure necessitated specific training of mail room personnel. Since an operator was required to physically measure materials and transpose the measurement to corresponding deck markings, potential sources of error occurred in taking initial measurements as well as transposition. Furthermore, a frequent source of error was the failure of operators to symmetrically center the guides.

As part of the operating cycle of the Pitney Bowes series 3300 inserters, two sets of three stripper fingers each entered the envelope throat to open the throat for acceptance of the enclosure and the ram blade. While envelope side guide and stop adjustments were provided in the series 3300 inserters, instances of jamming occurred which could be attributable to the inability of the stripper fingers to adequately adapt to variations in envelope dimensions. While the stop position of stripper fingers was adjustable, prior inserters did not employ means for laterally adjusting the stripper fingers to vary their entrance position relative to the center of an envelope.

SUMMARY OF THE INVENTION

A gauging system for an envelope inserter includes a gauging station panel having three slots. Each slot includes an index end and an adjustably positioned pointer adapted to frame a dimension of a specimen enclosure or envelope.

An enclosure slot receives a specimen enclosure lengthwise. An adjacent knob is rotated to drive a belt which carries the pointer. The knob shaft includes a pinion which drives a cam shaft extending through a chassis beneath an inserter frame. A pair of pivotally mounted follower arms engage a pair of cams secured to the shaft. The follower arms extend through the frame beneath a pair of spaced pick-up station decks. Enclosure side guides positioned on the decks are adjusted through a linkage driven by the follower arms. The distance between the side guides corresponds to the framed distance between the index end of the enclosure slot and the pointer.

For adjustment of an envelope stop gate at an envelope pick-up station, a similar slot which receives the side edge of an envelope is provided. A belt driven by a second knob carries a pointer for the slot and drives another belt which extends above an envelope gate cover. The driven belt engages the gate which is slidable relative to the cover.

The specimen envelope is inserted lengthwise into the third slot of the panel and is similarly framed with a pointer through rotation of a third knob. A shaft of the third knob rotates an envelope cam shaft extending through the chassis. A first pair of cams fixed to the shaft is engaged by a pair of follower arms which extend through the frame beneath an envelope station. The envelope follower arms drive a linkage connected to a pair of spaced envelope side guides at the envelope station.

A second pair of cams on the envelope shaft is engaged by a pair of horizontal followers which in turn displace a set of yokes which project through the frame. Each set of yokes engages a pair of collars which are slidably mounted to a pair of stripper finger shafts. A pair of stripper finger arms are carried by each collar and a stripper finger is linked between the corresponding arms of both collars. With the yoke engaging the collars, the pair of stripper fingers on each side of the inserter are laterally displaced to accommodate the length of the framed envelope.

From a setting to accommodate a small envelope, the stripper finger cams are contoured for initial movement of the stripper finger pairs away from one another with increasing envelope lengths. Initial stripper finger insertion into small envelopes is accomplished with an inner (non-displaceable) stripper finger and the adjacent stripper finger of a pair. When the envelope length increases to a specified dimension, the cam is contoured to retract the laterally displaced stripper fingers to their initial position. In the retracted position, the outer stripper fingers of each pair will now enter the large envelope mouth. With increased envelope length, the stripper finger pairs are again spread outwardly. To accommodate for the dwell in side guide movement during stripper finger retraction, a further cam driven by the third knob displaces the index end of the associated panel slot.

From the foregoing compendium, it should be appreciated that it is an object of the present invention to provide an inserter of the general character described having a gauging system which is not subject to the disadvantages of the prior art aforementioned.

A further object of the present invention is to provide an inserter of the general character described having a gauging system which fosters simplified inserter set up procedures to accommodate a run of a particular size envelopes and enclosures.

Yet another object of the present invention is to provide an inserter of the general character described having a gauging system which permits accurate, efficient and rapid adjustment of components to accommodate various sizes of materials being fed without the necessity for an operator to obtain or know the size of the materials being fed in unit measurements.

A still further object of the present invention is to provide an inserter of the general character described having a gauging system which is well adapted for usage by unskilled operators.

Another object of the present invention is to provide an inserter of the general character described having stripper fingers for opening the mouths of envelopes and a gauging system for adjusting the stripper fingers to accommodate various sizes of envelopes.

A still further object of the present invention is to provide an inserter of the general character described having a gauging system which provides readily accessible and simplified controls for accommodating various sizes of materials being fed.

Other objects of the present invention in part will be obvious and in part will be pointed out hereinafter.

With these ends in view, the invention finds embodiment in various combinations of elements and arrangements of parts by which the said objects and certain other objects are attained, all as fully described with reference to the accompanying drawings and the scope of which is more particularly pointed out and indicated in the appended claims.

BRIEF DESCRIPTION OF THE DRAWINGS

In the accompanying drawings in which is shown one of the various possible exemplary embodiments of the invention.

FIG. 17 is a further sectional view through the frame casting, the same being taken substantially along the plane 16—16 of FIG. 15 and better illustrating the manner in which the outer stripper finger arms are mounted to their respective collars;

FIG. 18 is a further sectional view through the frame casting, the same being taken substantially along the plane 18—18 of FIG. 15 and illustrating the engagement between a pair of intermediate stripper finger arms and their respective collars;

FIG. 19 is a further sectional view through the frame casting, the same being taken substantially along the plane 19—19 of FIG. 15 and illustrating the engagement between a pair of inner stripper finger arms and their respective collars;

DESCRIPTION OF THE PREFERRED EMBODIMENT

Figure 1:
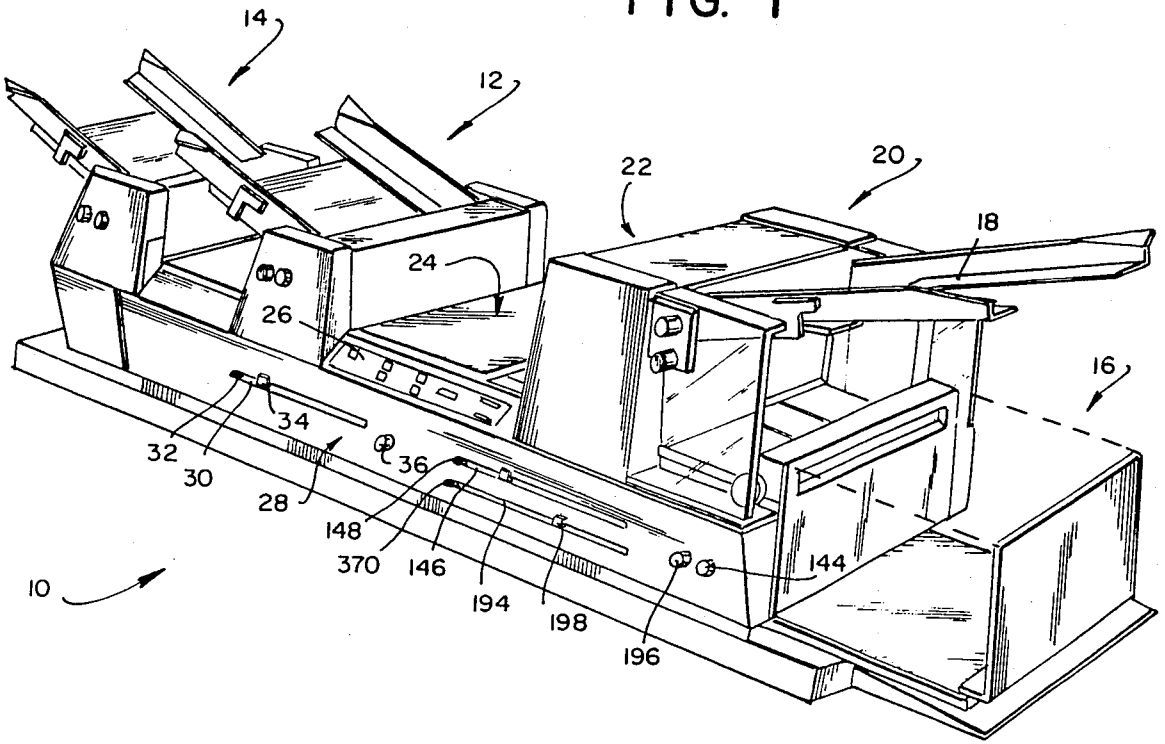
FIG. 1 is a perspective illustration of a typical inserter which includes a gauging system constructed in accordance with and embodying the present invention and showing a gauging panel having a plurality of slots at the front of the inserter.

Referring now in detail to the drawings, the reference numeral 10 denotes generally an inserter constructed in accordance with and embodying the present invention. The inserter 10 is similar in construction and operation to the Pitney Bowes Model 3320 Insertamate inserter and accordingly includes a first station enclosure feeder assembly 12 and a second station enclosure feeder assembly 14. The inserter 10 removes individual enclosures from stacks carried on the first, second or both enclosure feeder assemblies, stuffs the enclosures into an envelope and delivers each stuffed envelope to a stacker tray 16. An operator loads envelopes directly from an envelope carton into a hopper 18 of an envelope feeder assembly 20. Envelope flaps need not be pulled out since an envelope flapper 22 opens each flap prior to delivery of an envelope to an envelope station for insertion of the enclosure.

In operation, enclosures and envelopes are individually removed from their stacks by the respective feeder assemblies 12, 14 and 20. The enclosures are carried by belts to an enclosure pick-up station positioned beneath a bridge 24. At the pick-up station, successive enclosures are engaged by a ram mechanism which transports the enclosures into an envelope seated at an envelope station beneath and downstream from the envelope feeder assembly 20.

As more fully described in U.S. Pat. No. 2,914,895 entitled Envelope Stuffing Machine issued Dec. 1, 1959 to Samuel W. Martin, assigned to the assignee of the present invention and incorporated herein by reference, a group of claws or stripper fingers move into an envelope at the envelope station and open the envelope to facilitate insertion of an enclosure. The stripper fingers are arranged in groups of three on each side of a ram path and are spring urged into the envelope mouth. To actuate a forward stroke of the stripper fingers, the fingers are released from a retracted position by the ram mechanism when it commences its forward stroke. Continuation of the ram stroke after entry into the opened envelope carries the stuffed envelope to ejector rollers which deposit it in the stacker tray 16.

The inserter 10 includes various components for the transport and loading of enclosures, as well as the feeding, flapping and delivery of envelopes which are similar in structure to the corresponding components of the Pitney Bowes Model 3320 Insertamate inserter and/or the inserter disclosed in the Martin patent (supra). The present invention relates to a gauging system for simplifying the set up adjustments for the inserter 10.

The gauging system of the present invention is designed to provided simplified rapid adjustment of a pair of enclosure side guides which engage the ends of each enclosure for positioning the enclosure at the pick-up station. In addition, the gauging system provides simplified adjustment of an envelope station stop gate for positioning envelopes at the envelope station and adjustment of side guides at the envelope station along with coordinated adjustment of selected stripper fingers.

Referring now to FIG. 1, the inserter 10 includes a front operator station having a suitable control console 26 incorporating function switches, indicators, etc., and a planar gauging panel 28 beneath the control console 26. A plurality of slots are provided in the gauging panel 28 for receiving specimen materials, i.e. enclosures and envelopes, fed through the inserter.

The gauging panel 28 includes an enclosure slot 30 adapted for lengthwise reception of a specimen enclosure. An index end 32 projects through the slot 30. One end of an enclosure is rested against the index end 32 and a pointer 34 which is movable along the slot 30 frames the specimen enclosure with the pointer position controlled by rotation of an operator engageable knob 36.

Figure 2:
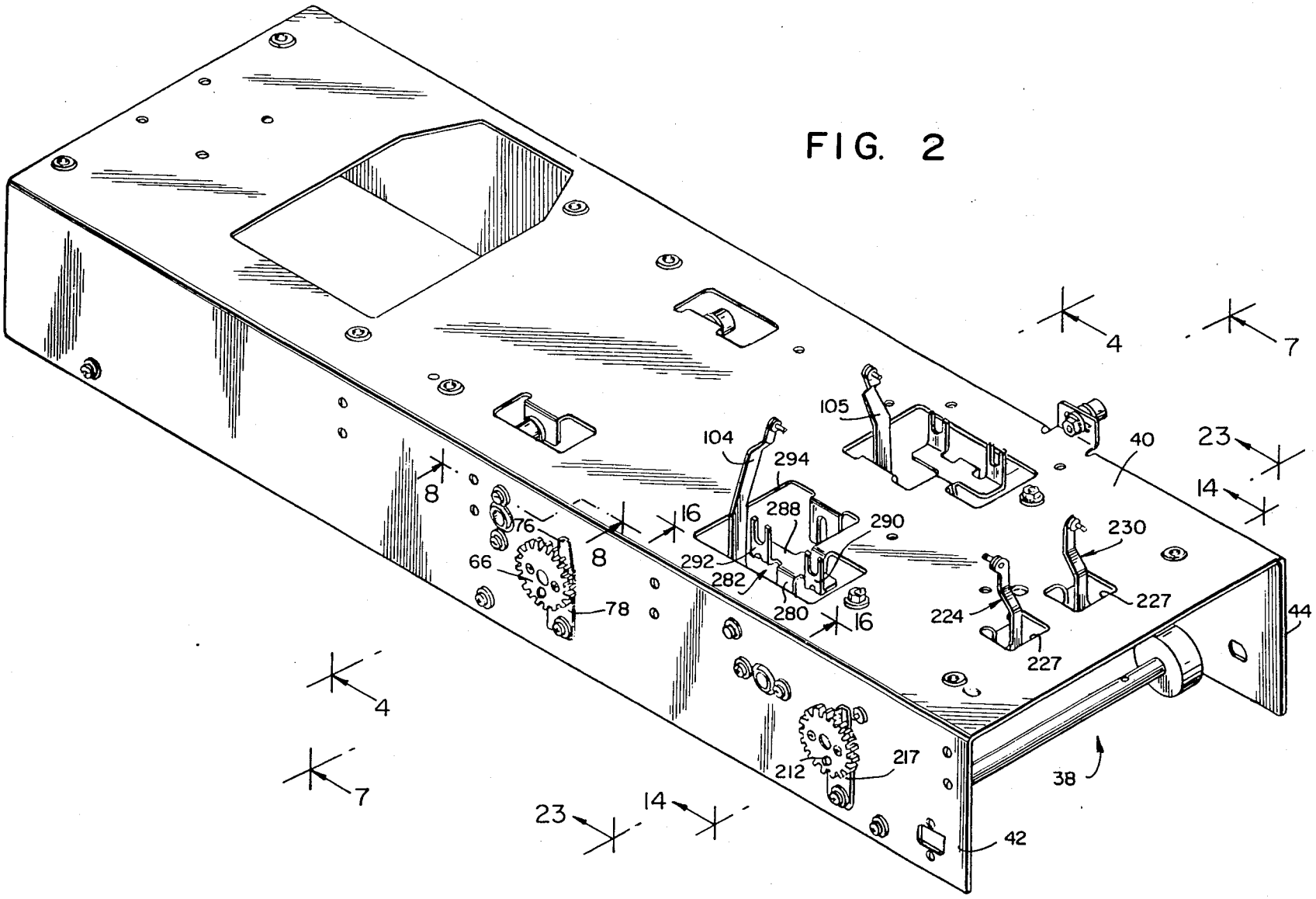
FIG. 2 is a perspective illustration of a chassis which extends beneath a frame casting, with the chassis housing a plurality of cams and follower mechanisms for adjustably positioning a pair of pick-up station side guides, a pair of envelope station side guides and selected stripper fingers.

The inserter 10 includes a frame casting 35 which carries the ram mechanism and feeder assemblies as well as the sets of stripper fingers. Positioned beneath the frame casting 35 is a chassis 38 illustrated in FIG. 2. The chassis 38 includes a generally planar top panel 40 and a pair of depending parallel side walls 42, 44.

An enclosure gauging station 46 (shown in FIG. 3) is positioned behind the gauging panel 28 in registration with the enclosure slot 30. The gauging station 46 includes a generally U-shaped channel 48 having a front wall 50 and a rear wall 52 which is secured to the side wall 42 of the chassis. At one end of the front wall 50, a forwardly bent flange includes a tab which projects through the slot 30 and forms the index end 32.

Figure 3:
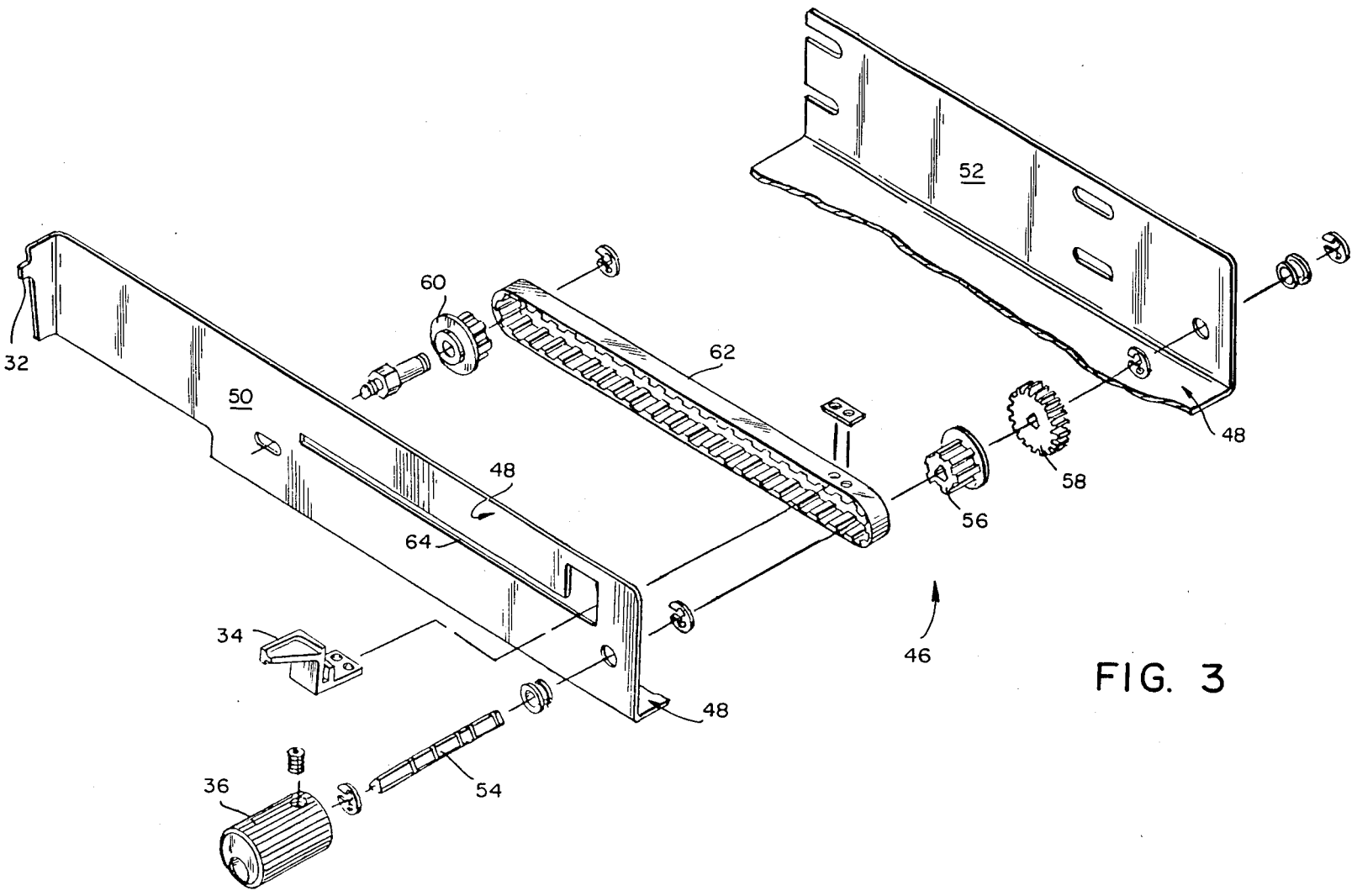
FIG. 3 is an exploded fragmentary perspective illustration of an enclosure gauging station which is positioned between the gauging panel and a side wall of the chassis.

As illustrated in FIG. 3, the knob 36 is fixed to a stub shaft 54 which is journalled in suitable bearings between the front and rear walls 50 and 52 of the channel 48. The shaft 54 carries a pinion 56 and a spur gear 58. A further pinion 60 is journalled for rotation about a post secured to the front wall 50 and a timing belt 62 is engaged between the pinions 56, 60.

The pointer 34 is carried by an upper of two parallel spans of the timing belt 62 and projects through a slot 64 formed in the front wall 50. Additionally, the pointer 34 extends through the registered slot 30 of the gauging panel 28.

It should be well appreciated that rotation of the knob 36 will cause translatory movement of the pointer 34 within the enclosure slot 30 and that an operator may rotate the knob 36 until the enclosure is framed lengthwise within the enclosure slot 30 between the index end 32 and the pointer 34. The enclosure is inserted into the slot until its longitudinal edge abuts the front wall 50.

Pursuant to the invention, rotation of the knob 36 for adjustment of the pointer 34 provides simultaneous adjustment of enclosure pick-up station side guides. Accordingly, the pinion 58 which is rotated by the stub shaft 54 is in driving engagement with a pinion 66 positioned adjacent the chassis side wall 42.

Figure 4:
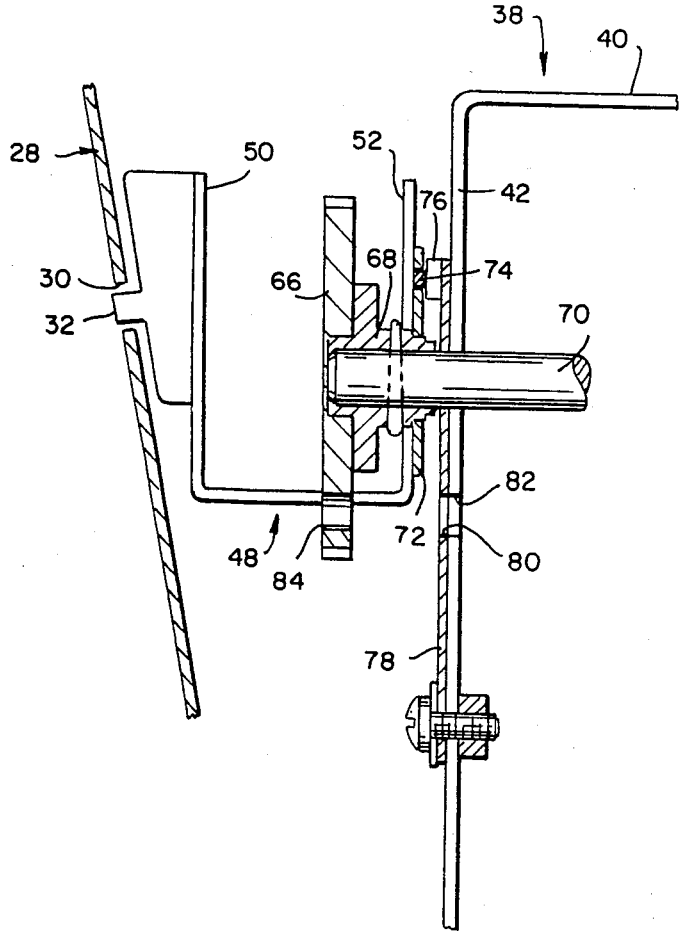
FIG. 4 is an enlarged scale sectional view through the panel, the enclosure gauging station and the side wall, the same being taken substantially along the plane 4—4 of FIG. 2 with details of the gauging station deleted for clarity.
Figure 5:
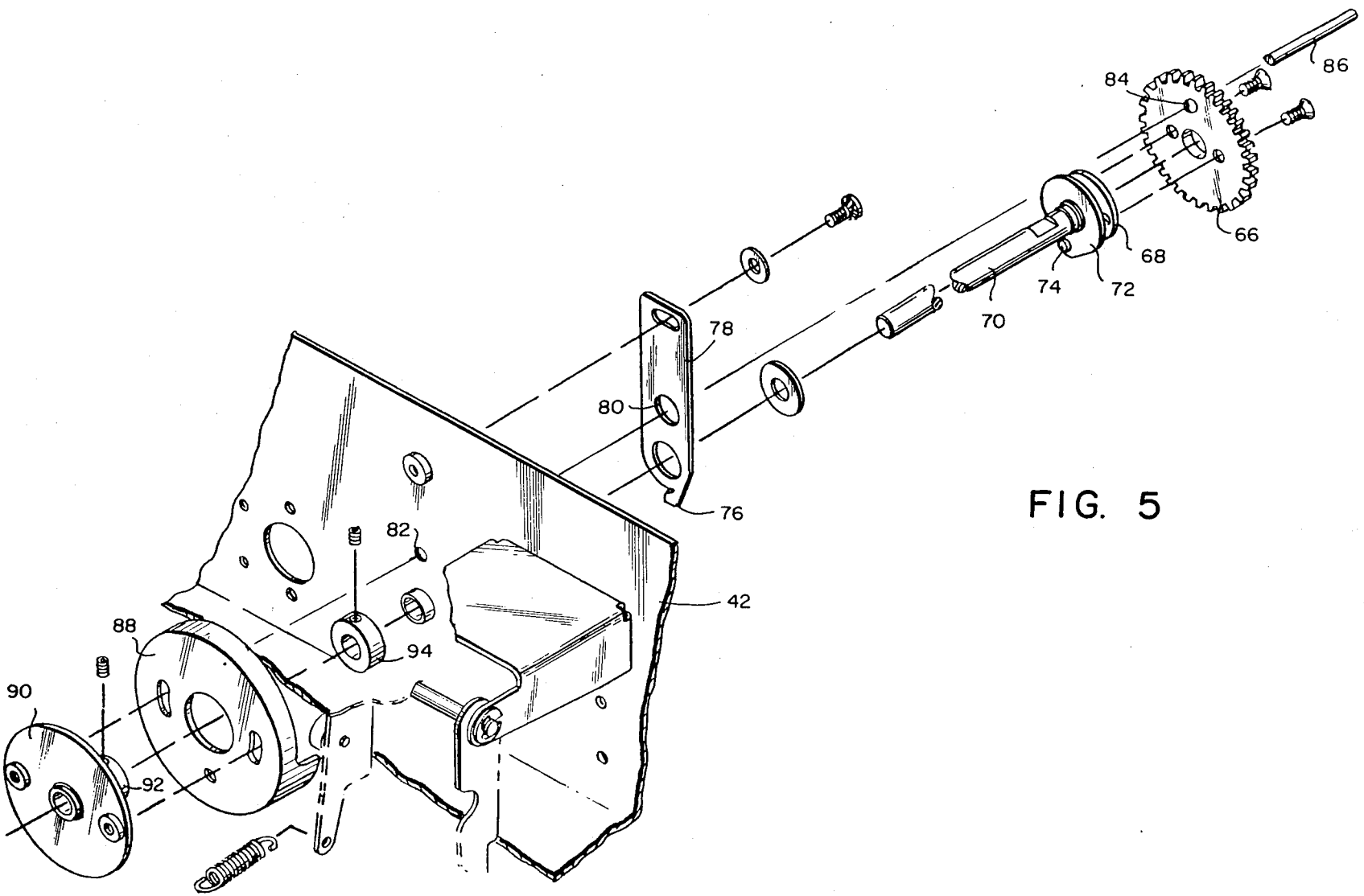
FIG. 5 is an inverted exploded fragmentary perspective view of the chassis and showing a gear, a cam and a cam shaft.

Referring now to the inverted view of FIG. 5 and the sectional view of FIG. 4, the pinion 66 is mounted to a flange of a hub 68 which is pinned to a cam shaft 70. The shaft 70 is journalled between the chassis side walls 42, 44. Additionally carried on the hub 68 is a further flange 72 having a rearwardly projecting stop pin 74. The stop pin 74 is adapted to engage with a stop shelf 76 which projects forwardly from an elongate plate 78.

The plate 78 includes an upper aperture through which the cam shaft 70 extends and a lower slot which is adapted to receive a mounting screw. Intermediate the cam shaft aperture and the slot, a timing aperture 80 is positioned. The timing aperture 80 is adapted for mutual registration with a corresponding aperture 82 in the side wall 42 and an aperture 84 in the pinion 66. During assembly of the inserter, a timing pin 86 (FIG. 5) is inserted through the apertures 80, 82, 84 and the screw which secures the plate 78 is then tightened. The cam shaft 70 is now at a reference position for setting cams.

Figure 7:
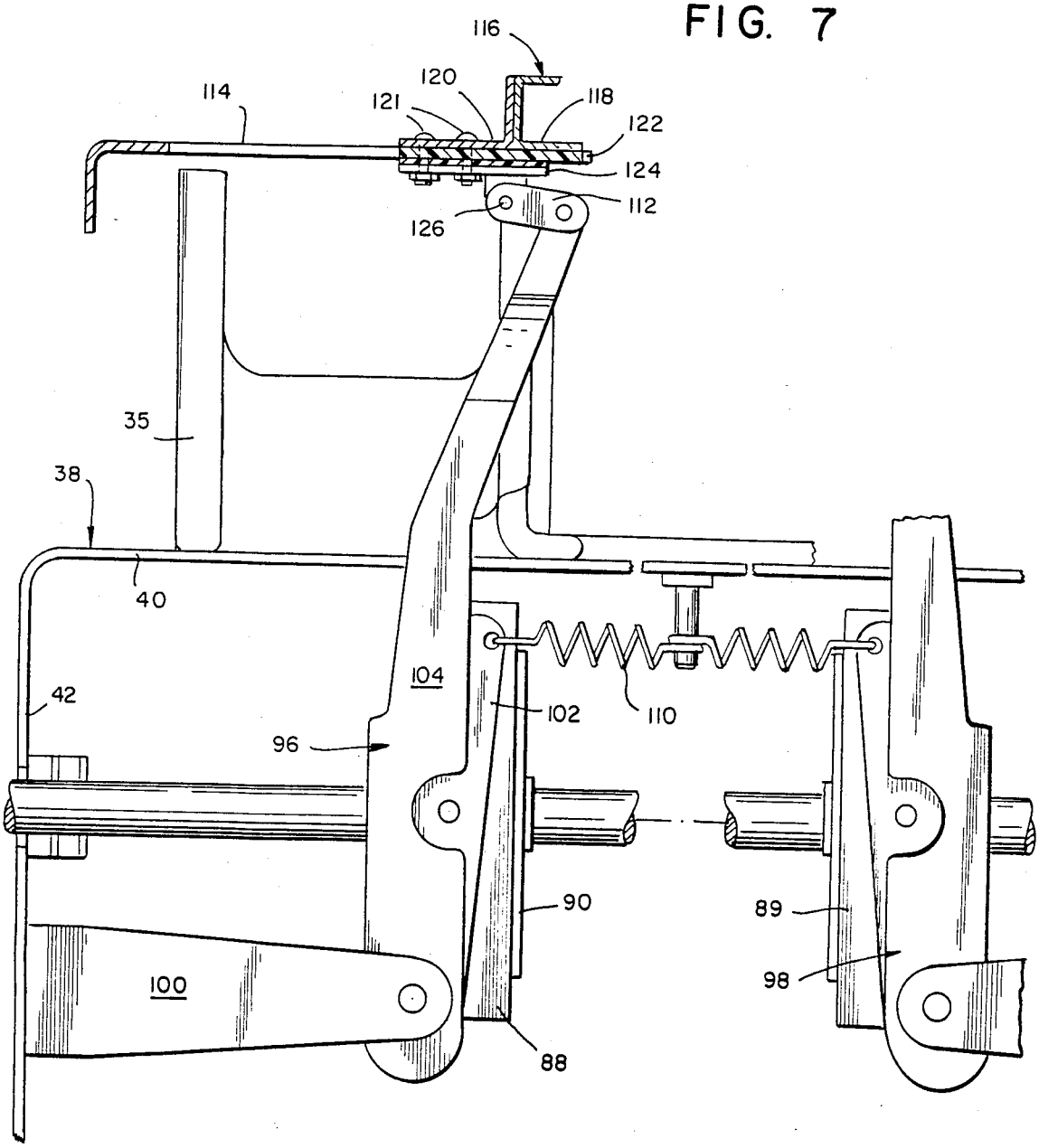
FIG. 7 is a fragmentary sectional view through the chassis and a portion of the frame casting, the same being taken substantially along the plane 7—7 of FIG. 2 and illustrating a link interconnecting a follower with an enclosure station side guide.

Additionally illustrated in FIG. 5 is a cylinder cam 88 which is contoured to vary the position of the enclosure pick-up station side guides. The cam 88 is secured to a flange 90 which is fixed to a hub 92, in turn fixed to the cam shaft 70. A collar 94 may be provided to prevent lateral displacement of the cam shaft 70. It should also be appreciated that a pair of symmetrically disposed cylinder cams are provided on the shaft 70 for mutual correlated adjustment of both enclosure pick-up station side guides as shown in FIG. 7.

The cylinder cam 88 adjacent the side wall 42 and a corresponding symmetrical cam 89 (FIG. 7) adjacent the side wall 44 (FIG. 6) are each engaged by a bracket follower 96, 98, respectively. While the bracket follower 96 will be described in greater detail, it should be understood that the bracket follower 98 is of identical construction with components symmetrically reversed.

Figure 6:
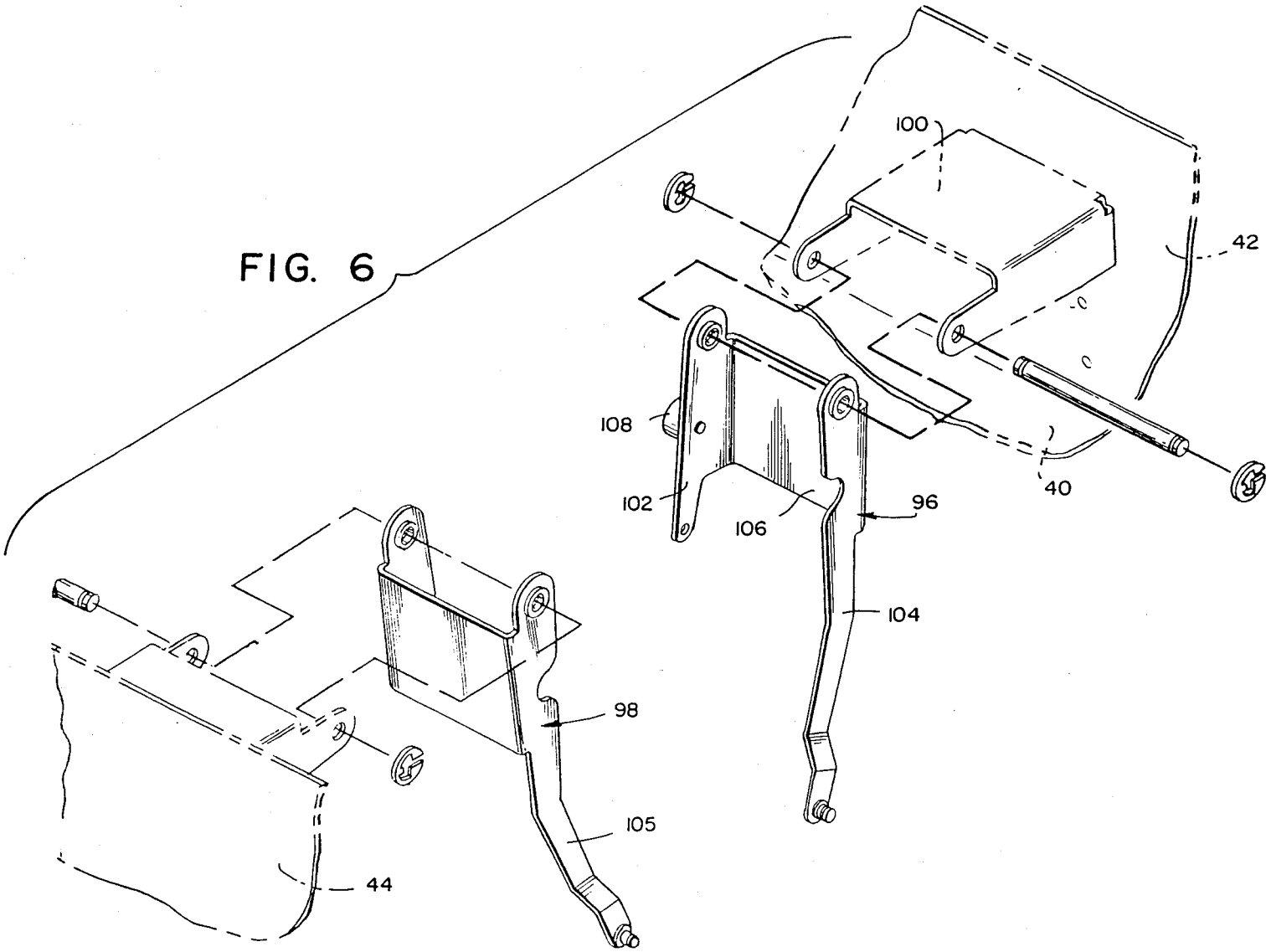
FIG. 6 is an inverted exploded fragmentary perspective view of both side walls of the chassis and showing details of a pair of cam followers and a pair of mounts.

A mount 100 projects inwardly from the side wall 42 and includes a pair of parallel arms having registered apertures. The bracket follower 96 includes a pair of substantially parallel legs 102, 104 joined by a web 106. At one end of each leg 102, 104 an aperture is provided with a bearing seated therein and the legs 102, 104 are spaced apart a distance to be receptively received between the arms of the mount 100 and pivotally joined thereto by a hinge pin as shown in FIG. 6.

The leg 102 includes a cam engaging roller 108 mounted to a pin and adapted to engage the camming surface of the cam 88. An aperture is provided at the free end of the leg 102 to receive a spring 110 which biases the follower 96 so that the roller 108 is urged against the camming surface of the cylinder cam 88.

The opposite leg 104 projects upwardly through a suitable aperture in the chassis top panel 40. The end of the leg 104 terminates at a post which is journalled within an aperture formed in a cross link 112.

The leg 104 and the corresponding leg 105 of the symmetrical bracket follower 98 project upwardly into the frame casting 35 beneath a pair of spaced parallel enclosure pick-up station decks. A deck 114 adjacent the face of the inserter is illustrated in FIGS. 7 and 8.

An enclosure side guide 116 is adjustably mounted to the deck 114. The side guide 116 includes a generally C-shaped channel 118 and a generally L-shaped mounting bracket 120. A plurality of bolts 121 extend between a horizontal leg of the bracket 120 and a retaining plate 124 on the underside of the deck 114. The bolts 121 also extend through a spacer 122 positioned within a transverse slot formed in the deck 114.

Figure 8:
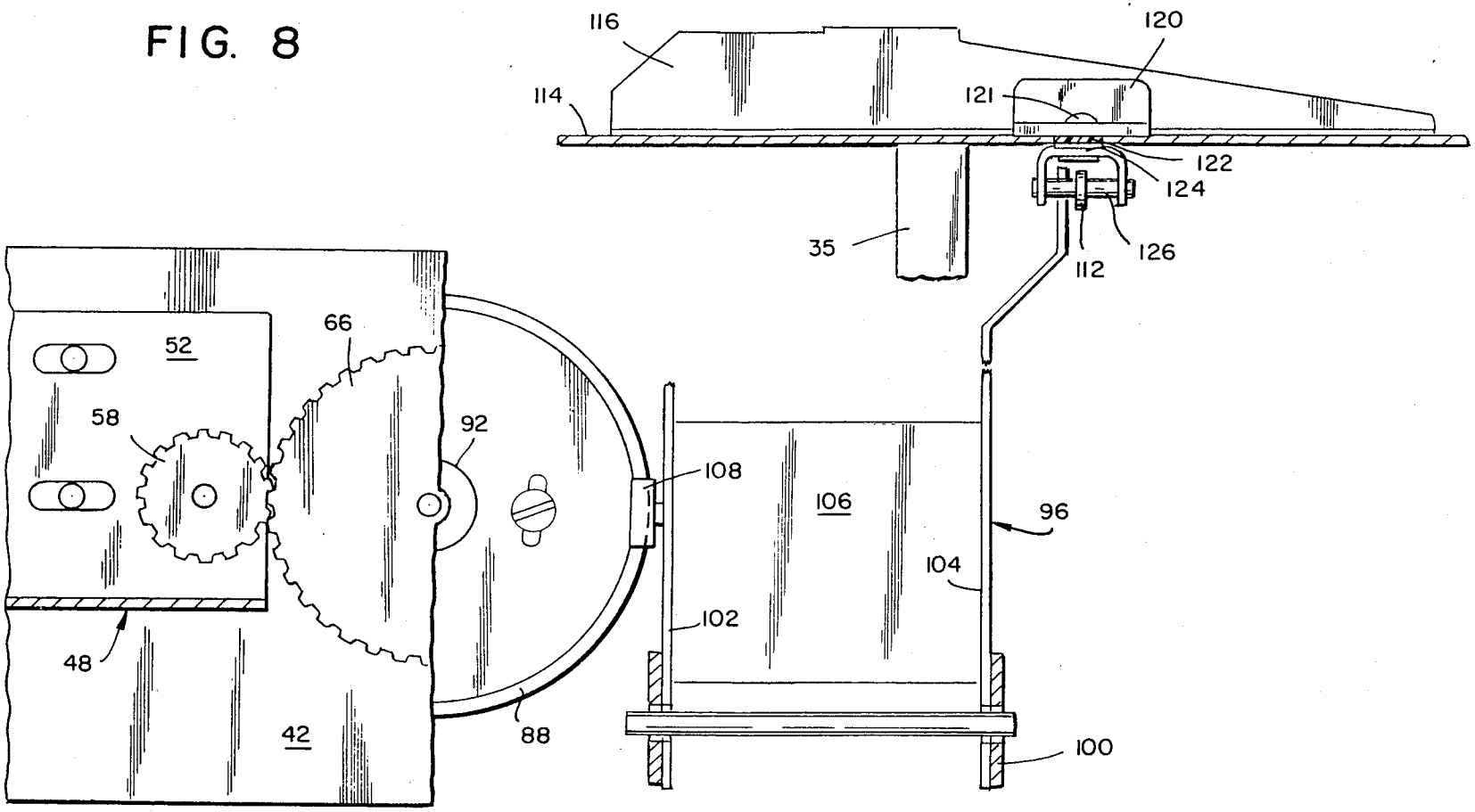
FIG. 8 is a fragmentary sectional view through a portion of the enclosure gauging station and the chassis, the same being taken substantially along the stepped plane 8—8 of FIG. 2.

Referring now to FIG. 8, it will be seen that the plate 124 includes a pair of downturned arms having apertures through which a pin 126 extends. The cross link 112 includes an aperture which receives the pin 126. When the leg 104 rotates about the pin of the mount 100 in response to rotation of the cylinder cam 88, the cross link 112 permits planar translational movement of the side guide 116 within its slot along the deck 114.

As previously mentioned, a symmetrically disposed cylinder cam 89, bracket follower 98, deck side guide and linkage are provided for the pick-up station deck at the far side of the inserter. Furthermore, the camming faces of the cylinder cams 88, 89 are contoured and the followers and links are proportioned so that the distance between the inner walls of the opposed side guide channels 118 equate with the distance between the index end 32 and the pointer 34 of the slot 30. The side guides are equidistantly spaced from the center line of the ram path at all times.

Figure 14:
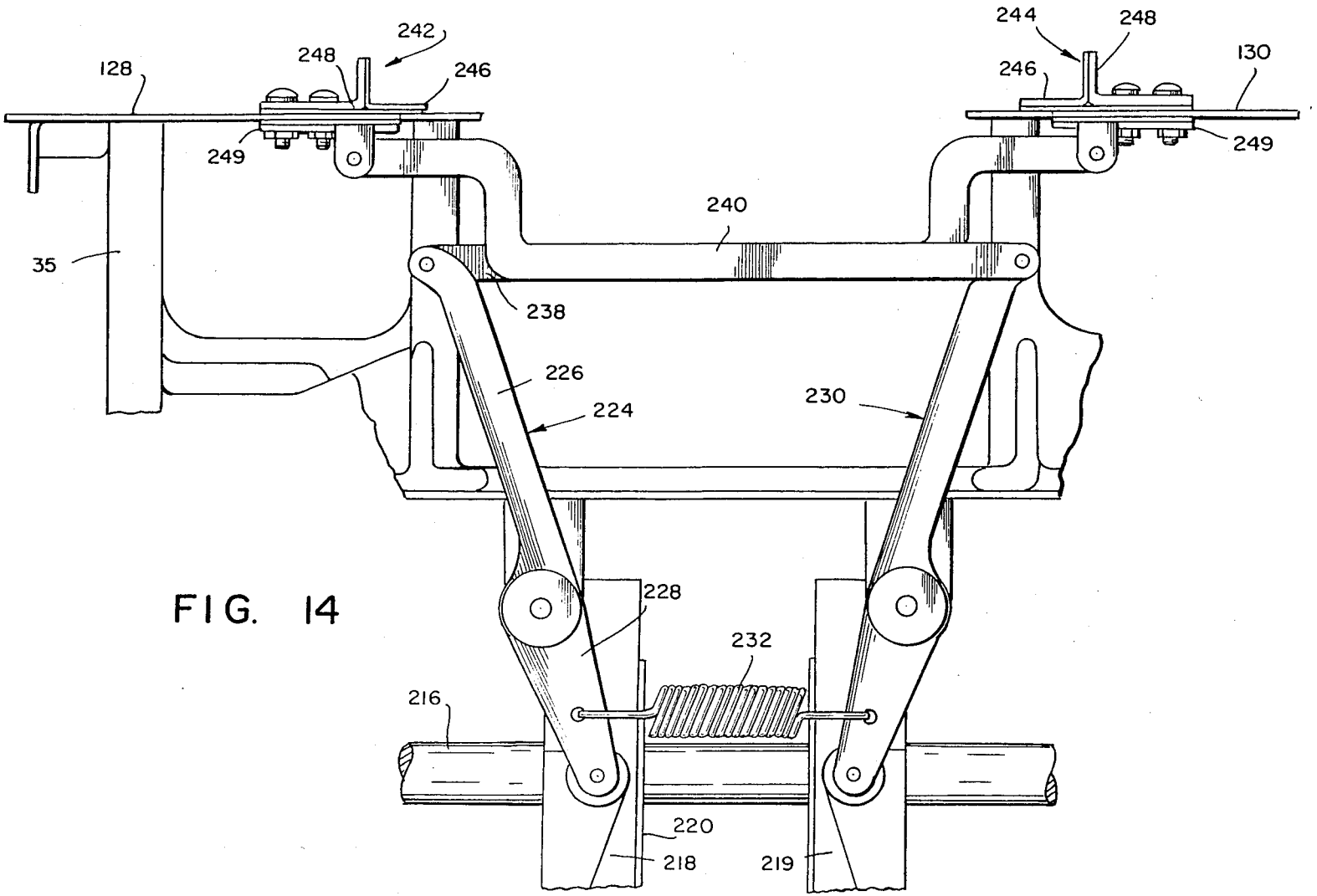
FIG. 14 is an enlarged sectional view through the chassis and the frame casting, the same being taken substantially along the plane 14—14 of FIG. 2 and showing a linkage which interconnects the envelope side guide followers with the envelope side guides.

An envelope station is provided beneath and partially downstream of the envelope feeder assembly 20. As shown in FIG. 14, the envelope station includes a pair of spaced parallel decks 128, 130 upon which an envelope is supported.

Figure 11:
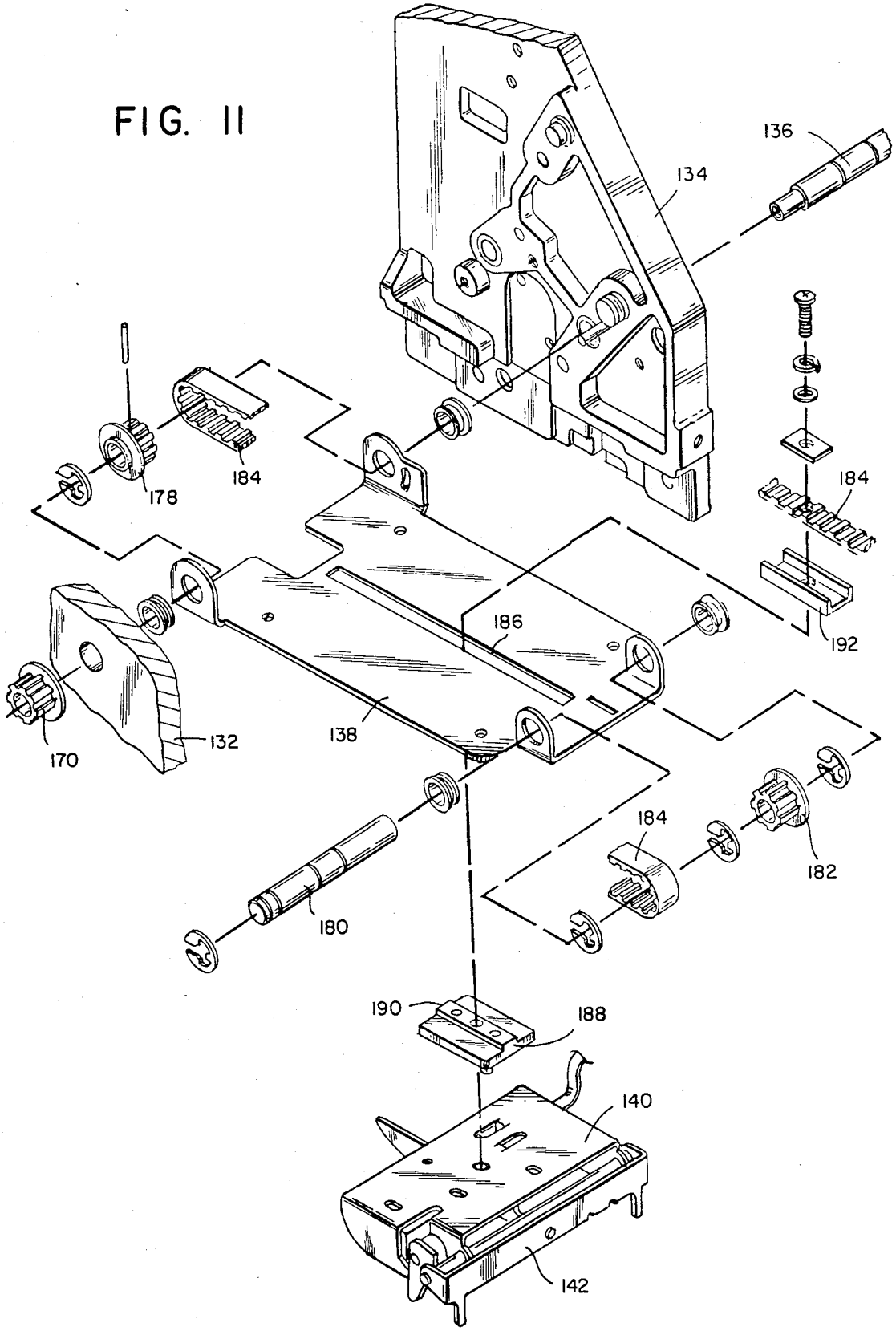
FIG. 11 is an exploded fragmentary perspective view of an envelope gate and a side frame with portions deleted for clarity and showing the driven shaft to which an envelope gate cover is journalled and an adjustment belt driven by the shaft.

The envelope feeder assembly 20 includes a pair of spaced parallel side frames 132, 134 illustrated in FIG. 11. A shaft 136 extends transversely between the side frames 132, 134 and an envelope gate cover 138 is journalled at its rearward end about the shaft 136.

Mounted beneath the cover 138 is an envelope stop gate 140 which is constructed in a manner similar to the envelope stop gate employed in the Pitney Bowes Model 3320 inserter. In the Model 3320 inserter, the stop gate was manually adjusted by an operator to engage the longitudinal edge of an envelope and thus "stop" the envelope at a dwell position for reception of an enclosure. A stop bracket 142 includes depending fingers which engage the leading longitudinal edge of an envelope. When the ram blade enters the envelope and drives the envelope forward, it causes the bracket 142 to pivot, thereby permitting the envelope to be fed to ejector rollers.

Pursuant to the present invention, the envelope stop gate 140 is adjustable positioned by an operator engageable knob 144 accessible at the gauging panel 28. The knob 144 is adjacent a slot 146 which is adapted to receive a widthwise inserted specimen envelope.

An envelope gauging station 150 (illustrated in FIG. 9) is positioned behind the gauging panel 28 in registration with the slot 146. The gauging station 150 includes a generally U-shaped channel having a front wall 152 and a rear wall 154 with the rear wall 154 secured to the side wall 42 of the chassis 38. At an upper corner of the front wall 152, a forwardly projecting flange includes a tab which projects through the slot 146 and forms the index end 148.

The knob 144 is secured to a stub shaft 156 which is journalled between the front and rear walls 152, 154. The shaft 156 includes pinion 158 fixed thereto with the pinion 158 driving a further pinion 160 fixed to a further stab shaft 162.

The shaft 162 is journalled for rotation between the walls 152, 154 and carries a timing belt pinion 164. A width gauging belt 166 engages the pinion 164 and a further idler pinion 168 which is journalled about a post extending from the rear wall 154.

Figure 10:
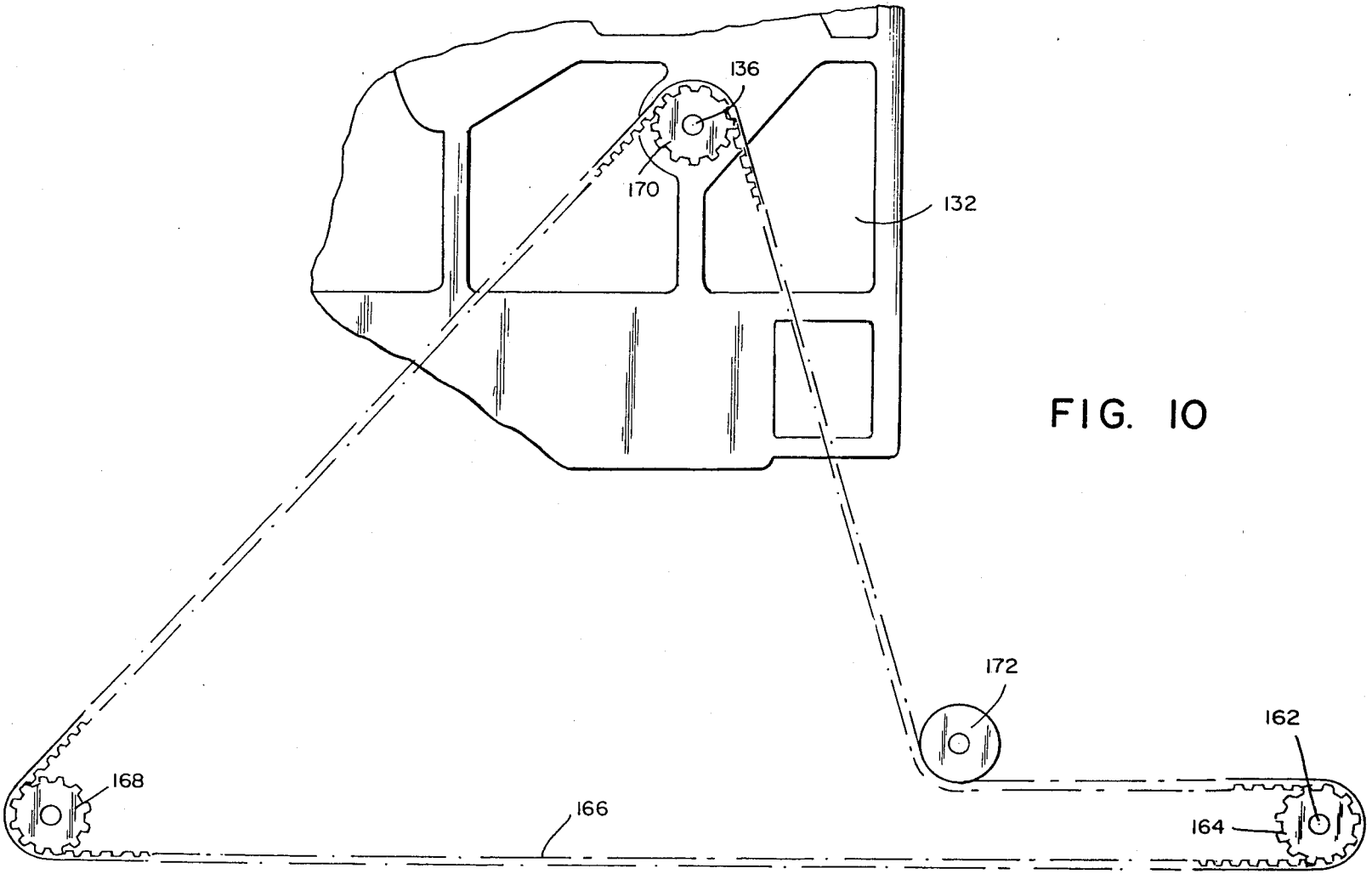
FIG. 10 is a schematized diagramatic elevational view of an envelope width gauging belt which smultaneously adjusts a pointer and rotates a drive shaft extending between a pair of side frames for adjustment of an envelope stop gate.

Referring now to FIG. 10 wherein an elevational profile of the width gauging belt 166 is shown, the top span of the belt 166 extends upwardly and is looped over a further pinion 170 which is fixed to the shaft 136 projecting from the envelope feeding assembly side frame 132. The width gauging belt 166 is tensioned with a laterally adjustable pulley 172 which is journalled about a post slidably mounted to the rear wall 154.

A pointer 174 is mounted to the bottom horizontal span of the belt 166 and projects through an upper slot 176 formed in the front wall 152. The pointer 174 extends through the width gauging slot 146 in the gauging panel 28.

When an operator rotates the knob 144 to frame an envelope between the index end 148 and the pointer 174 of the slot 146, movement of the width gauging belt 166 drives the pinion 170 and causes the shaft 136 to rotate.

Referring again to FIG. 11, the envelope gate cover 138 is pivotally mounted to the shaft 136 and a spur gear 178 rotates with the shaft 136. At the forward end of the envelope gate cover 138, a shaft 180 is journalled between a pair of upturned apertured flanges and carries an idler 182. A further timing belt 184 is in engagement with the spur gear 178 and the idler 182 and extends above an elongate slot 186 in the cover 138.

Positioned between the envelope stop gate 140 and a channel 192 on the top of the cover 138 is a spacer block 188 having an upwardly projecting rail 190 which is received in the slot 186. The lower span of the timing belt 184 is seated in the channel 192 and a suitable fastener such as a bolt extends through registered apertures in the timing belt 184, the channel 192 and the envelope stop gate 140. When the shaft 136 rotates, the envelope stop gate 140 translates longitudinally relative to the envelope stop gate cover 138 and along a path guided by the slot 186 due to the rotation of the timing belt 184.

Referring again to FIG. 1, a further slot 194 in the gauging panel 128 is adapted to lengthwise reception of a specimen envelope. A corresponding knob 196 provides an adjustment control of an associated pointer 198.

Figure 9:
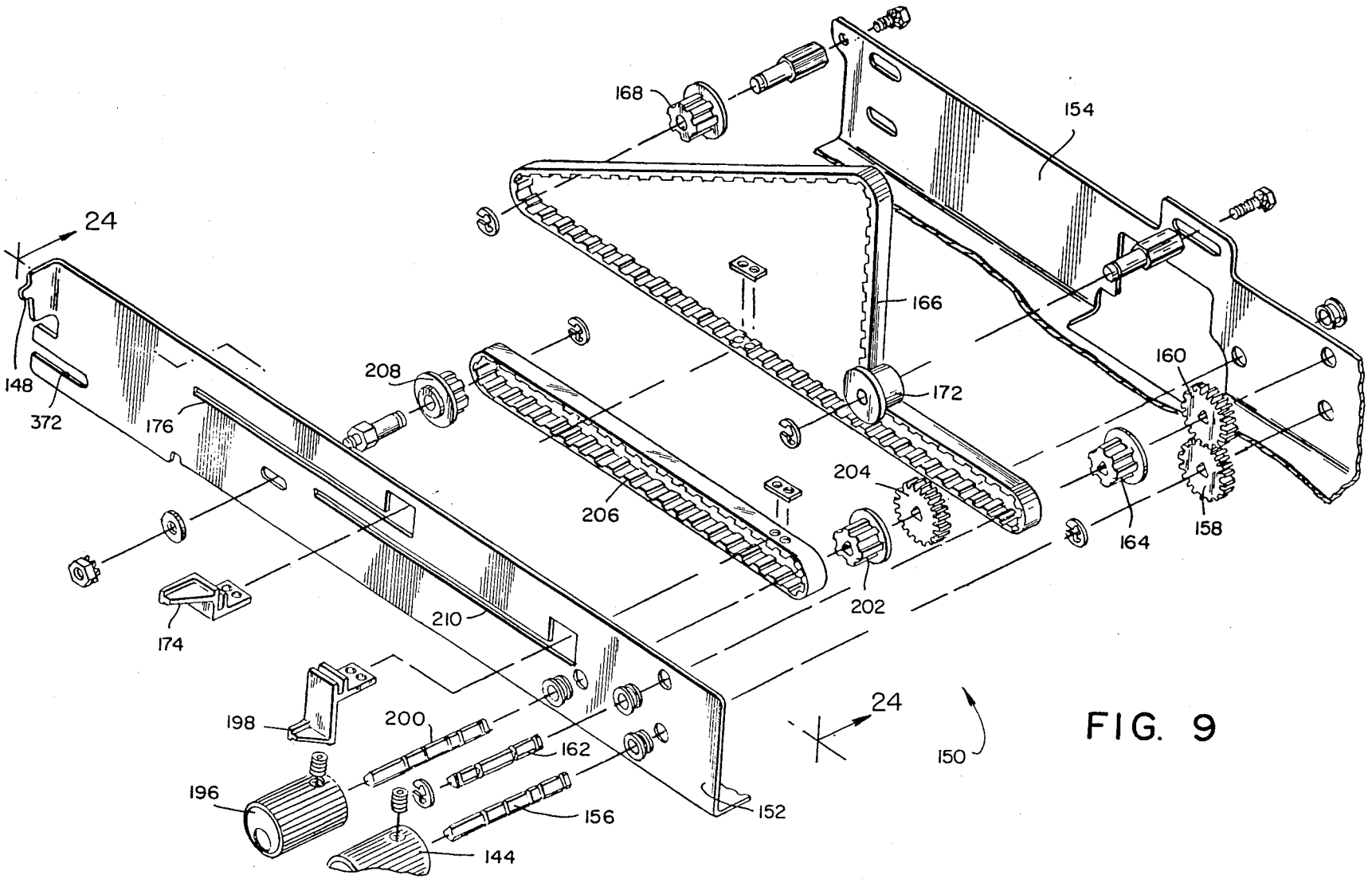
FIG. 9 is an exploded fragmentary perspective illustration of an envelope gauging station which extends between the inserter panel and the side wall of the chassis.

As shown in FIG. 9, the knob 196 is fixed to one end of a stub shaft 200 which is journalled between the front and rear walls 152, 154 of the envelope gauging station 150. A timing belt pinion 202 and a spur gear 204 are fixed to the stub shaft 200. The timing belt pinion 202 engages a timing belt 206 which spans between the pinion 202 and an idler pinion 208 journalled about a post which in turn is adjustably fixed to the front wall 152. It should be noted that the timing belt 206 for envelope lengthwise gauging is positioned beneath the lower span of the envelope width gauging belt 166.

The pointer 198 is carried by the upper of two parallel spans of the timing belt 206 and projects through a slot 210 formed in the front wall 152. The pointer 198 also extends through the registered slot 194 in the gauging panel 28. Rotation of the knob 196 drives the belt 206 and causes the pointer 198 to move along the slots 210, 194.

As previously discussed, the stub shaft 200 additionally carries a spur gear 204. The spur gear 204 is positioned rearwardly of the timing belt pinion 202 and drives a pinion 212 positioned adjacent the chassis side wall 42.

Figure 12:
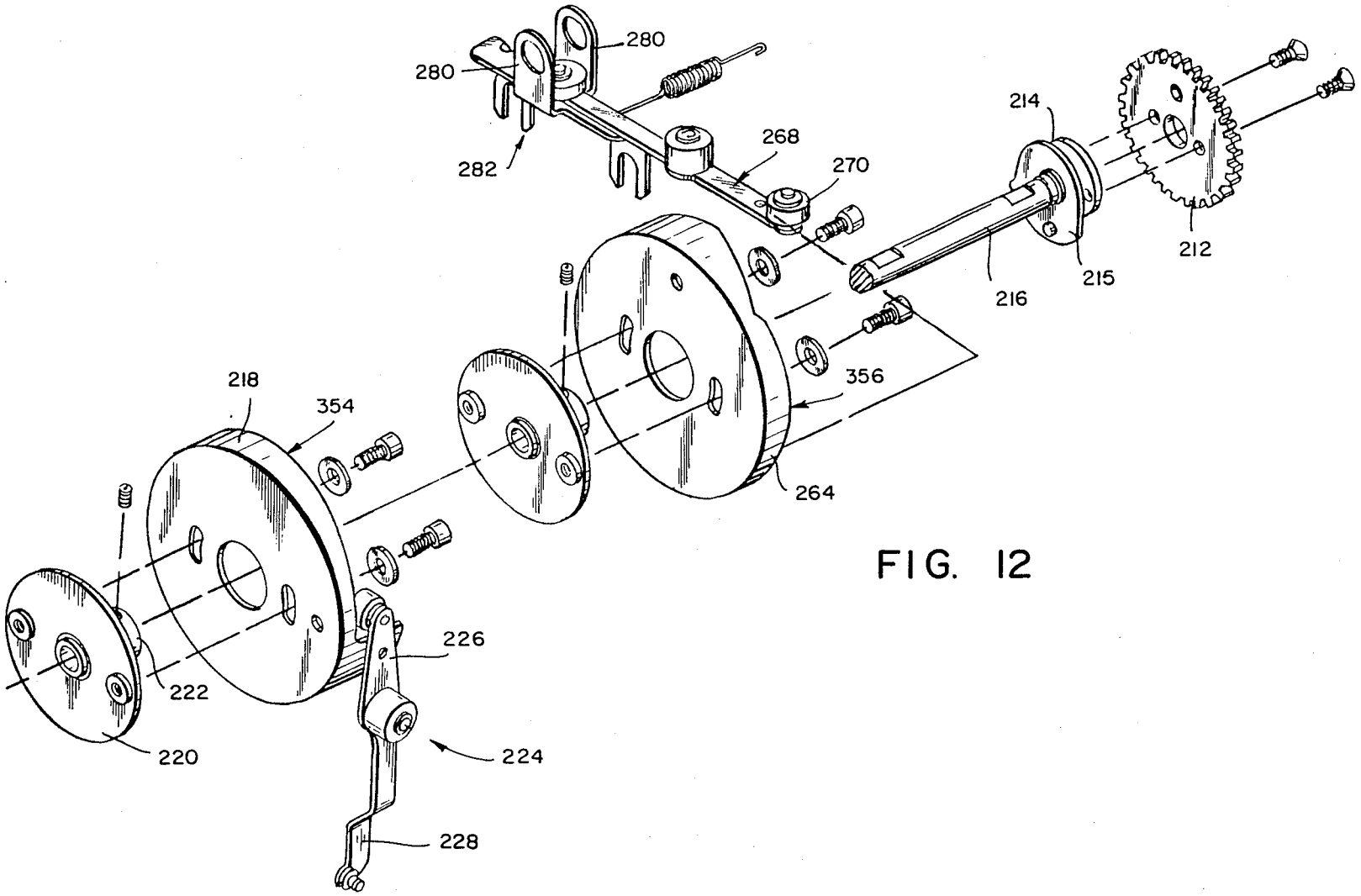
FIG. 12 is an inverted exploded fragmentary perspective view of a further cam shaft journalled between the side walls of the chassis and which is adapted to simultaneously adjust the position of a pair of envelope side guides and pairs of stripper fingers and showing the engagement between a side guide cam and its follower as well as between a stripper finger cam and its follower.

Referring now to the inverted exploded view of FIG. 12, the pinion 212 is mounted to a flange of a hub 214 which is pinned to a cam shaft 216. The cam shaft 216 is journalled between the chassis sidewalls 42, 44. The hub 214 carries a cam flange 215 having a rearwardly projecting stop pin which engages a stop shelf projecting from an elongate plate 217 (FIG. 24) in a manner identical to the corresponding components previously described with reference to the hub 68 (FIG. 4) of the enclosure side guide pinion 66. It should also be noted that a timing pin may be received through registered apertures in the pinion 212 (FIG. 12), the elongate plate and the side wall 42 (FIG. 4) of the chassis as described with reference to the pinion 66.

As shown in FIG. 12, a pair of envelope side guide cylinder cams 218, 219 are carried on the cam shaft 216. The cams 218, 219 are symmetrical about the longitudinal axis of the inserter; only one side guide cam will be described in detail. The cam 218 is secured to a flange 220 which is fixed to a hub 222 mounted to the cam shaft 216. A follower 224 includes a lower arm 226 which carries a roller in spring biased engagement against the camming surface of the cam 218 and an upwardly projecting arm 228 which extends through an aperture 227 in the top panel 40.

Figure 13:
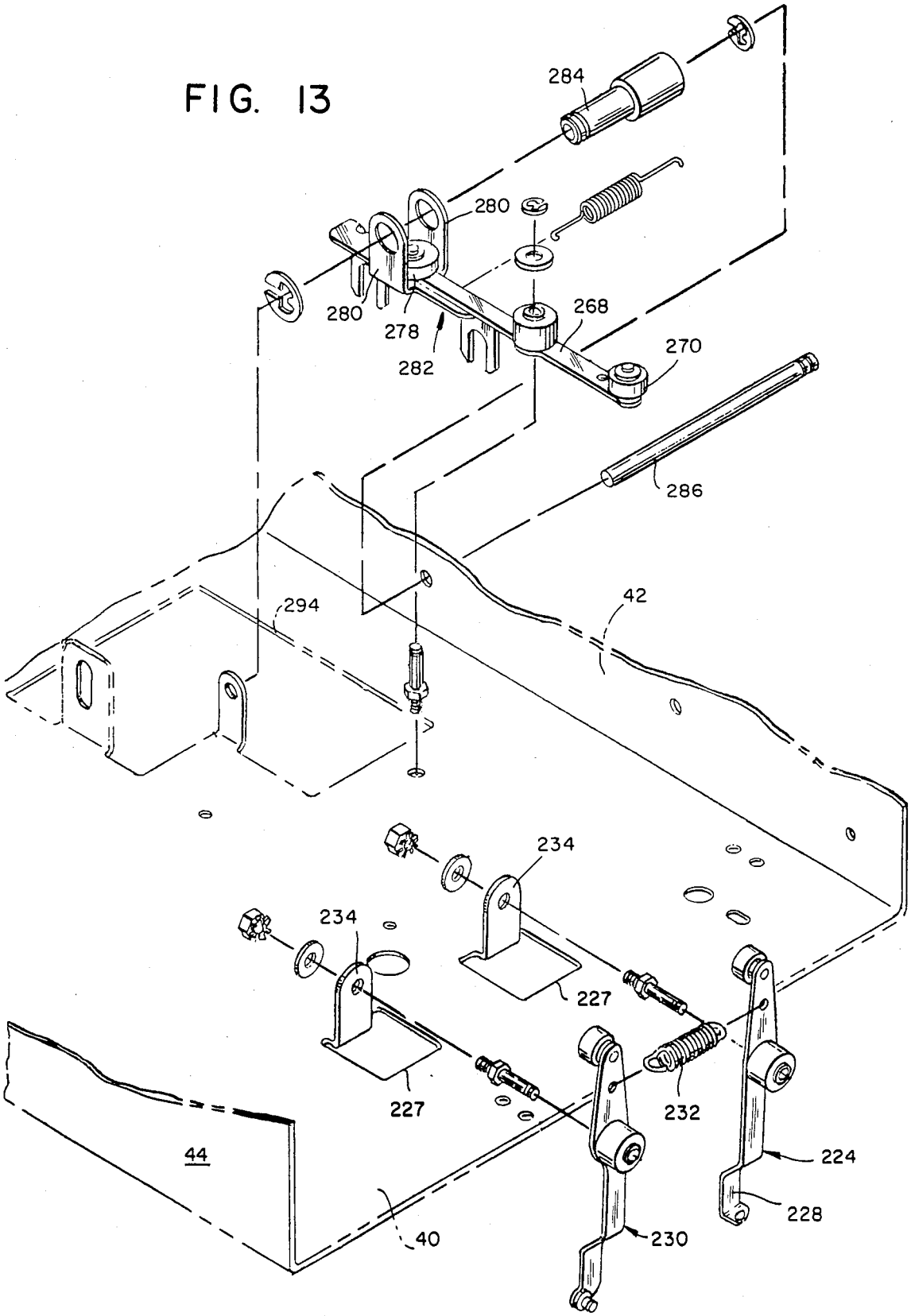
FIG. 13 is an inverted exploded fragmentary perspective illustration of the underside of the chassis and better illustrating the manner in which the side guide and stripper finger followers are pivotally mounted to the chassis.

As illustrated in FIG. 13, the follower 224 and a corresponding follower 230 which engages the cylinder cam 219 are each pivotally mounted to a horizontal post which, in turn, is fastened to a bracket 234 extending downwardly from the top panel 40. The rollers of the followers 224, 230 are spring biased against the camming surfaces by a helical coil spring 232 which spans between their upper arms.

A pin projecting from the upper end of the followers 224, 230 engages an aperture formed at the end of a horizontal span of a tie rod 238, 240, respectively. Each tie rod 238, 240 extends upwardly adjacent its opposite end and includes a further aperture for engagement with one of a pair of envelope side guides 242, 244.

Each envelope side guide 242, 244 comprises a channel 246 which engages the ends of an envelope positioned on the decks 128, 130 and an L-shaped bracket 248. The envelope side guides 242, 244 are slidably mounted to their respective decks 128, 130 in a manner similar to that previously described with respect to the enclosure side guides 116. Accordingly, fasteners extend from the bracket 248 to a plate 249 and through a spacer which extends within a lateral slot formed in the respective decks.

The plate 249 is similar to the plate 124 previously described and includes a pair of downturned arms and a pin extending through registered apertures in each arm. As illustrated in FIG. 14, the pin of the side guide 242 extends through the aperture formed at the upper end of the tie rod 240, while the pin on the envelope side guide 244 extends through the aperture formed at the upper end of the tie rod 238.

Clockwise rotation of the knob 196 drives the cam shaft 216 counterclockwise. This, in turn, will cause the follower 224 to rotate clockwise and the following 230 to rotate counterclockwise (both as viewed from FIG. 14). Such movement of the followers 224, 230 will result in lateral displacement of the envelope side guides 242, 244 away from one another, thereby accommodating a longer envelope. Simultaneously, the pointer 198 is displaced away from the index end of the slot 194 with the distance between the pointer 198 and the index end of the slot equating to the distance between the envelope side guides 242, 244. Rotation of the knob 196 in a reverse direction to provide clockwise rotation of the cam shaft 216 will bring the side guides 242, 244 toward one another and will move the pointer 198 toward the index end of the slot.

The inserter disclosed in the Martin patent included two arrays of stripper fingers or claws associated with each envelope deck. Each array comprised three stripper fingers, i.e. an inner stripper finger (closest to the longitudinal center of the inserter) spaced inwardly from the inner edge of the associated envelope deck, an intermediate stripper finger and an outer stripper finger.

Figure 15:
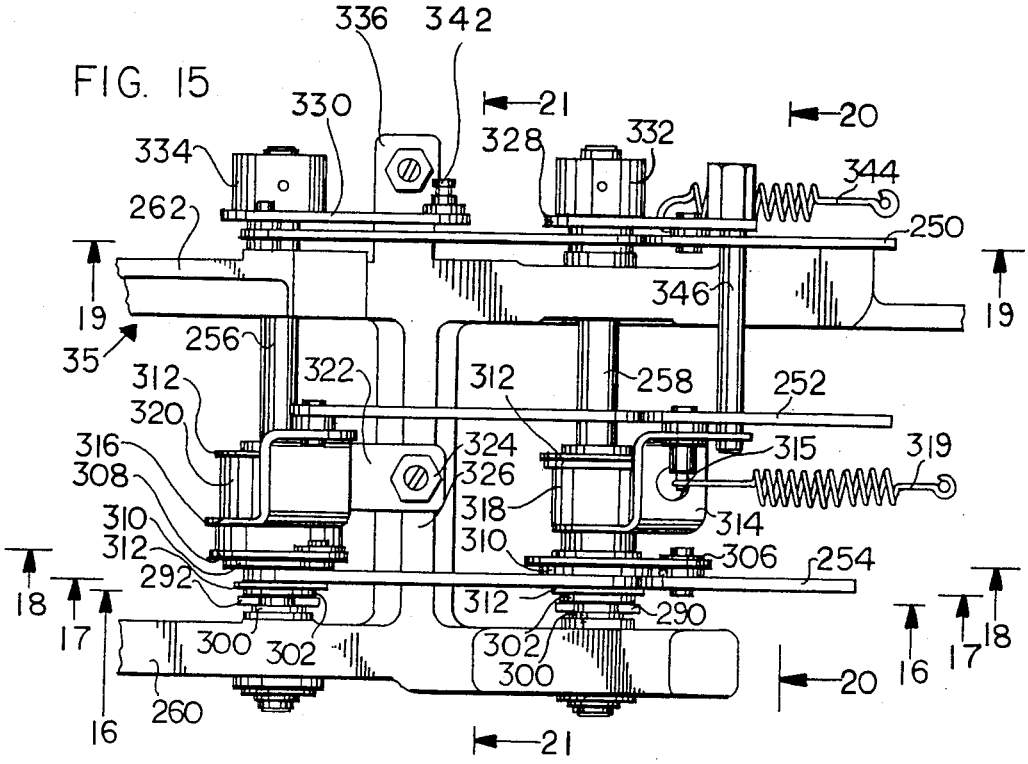
FIG. 15 is a fragmentary plan view of a portion of the inserter frame with the enclosure and envelope decks removed and showing a set of stripper fingers.

Referring now to FIG. 15 which comprises a plan view of a stripper finger array with the envelope station deck 128 and the pick-up station deck 114 removed, the stripper finger array includes an inner stripper finger 250, an intermediate stripper finger 252 and an outer stripper finger 254. It should be understood that a further stripper finger array is positioned adjacent the rear face of the inserter. The following description of the array illustrated in FIG. 15 is exemplary of both arrays.

The stripper finger array is mounted to a pair of stripper fingers shafts 256, 258 which extend between a pair of parallel ribs 260, 262 of the frame casting 35. Each stripper finger shaft 256, 258 includes a plurality of planar flats along the periphery thereof which provide a transverse cross sectional configuration similar to that of an equilateral triangle having rounded apices.

In accordance with the present invention, the inner stripper finger 250 is carried by a pair of arms for reciprocal movement within a fixed vertical plane parallel to the longitudinal center line of the inserter. The intermediate and outer stripper fingers 252, 254 respectively are laterally adjustable toward or away from the inner stripper finger to thereby accommodate envelopes of different sizes.

Figure 23:
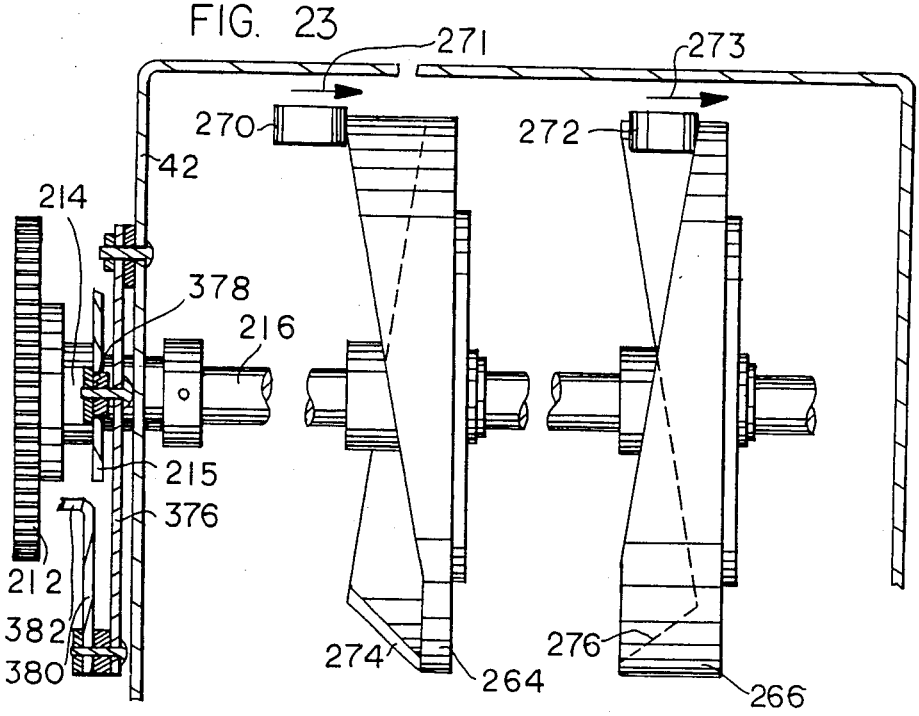
FIG. 23 is an enlarged sectional view through the chassis, the same being taken substantially along the plane 23—23 of FIG. 2 and showing a follower journalled to a post on the side of the chassis for moving the index end of a slot which receives envelopes lengthwise; additionally illustrated are the stripper finger cams.

Referring now to FIGS. 12, 13 and 23, the cam shaft 216 carries a pair of stripper finger cams 264, 266, each fixed to a flange which is attached to a hub in a manner identical to that employed with respect to the envelope side guide cams 218, 219. Each stripper finger cam 264, 266 is positioned on the cam shaft 216 between an envelope side guide 218, 219 and a side wall 42, 44 of the chassis 38.

The stripper finger cam 264 is engaged by a follower 268 which is pivotally mounted to a vertical post which extends downwardly from the top panel 40. A spring having one end anchored to the chassis 38 and the other end fixed to the follower 268 biases a roller 270 of the follower 268 against the camming surface of the cam 264. The direction of biasing force is indicated in FIG. 23 by an arrow 271.

From an observation of FIG. 23, it will be seen that the stripper finger cam 266 is not symmetrical with the cam 264 about the longitudinal axis of the inserter. Both cams 264, 266 have camming surfaces facing the front wall 42 of the chassis 38. A biasing spring (not shown) urges a roller 272 of the follower which is driven by the cam 266 in the same direction as the roller 270 of the follower 268 also as illustrated in FIG. 23 by an arrow 273.

Since the camming surfaces of the cams 264, 266 actually are symmetrically about the longitudinal axis of the inserter, rotation of the cam shaft 216 which results in the tensioning of one of the follower biasing springs will simultaneously result in the relaxing of the other biasing spring. This arrangement is particularly designed to facilitate smooth operation of the engaging system at a pair of registered steeply inclined areas 274, 276 of the cams 264, 266 respectively without the employment of additional force multiplication apparatus for rotating the cam shaft 216.

The end of each stripper finger follower opposite its cam engaging roller 270, 272 respectively includes a further roller 278 which is straddled between a pair of legs 280 extending downwardly from a bracket 282.

As indicated in FIG. 13, the legs 280 include apertures through which a cylindrical sleeve 284 is positioned. The sleeve 284 includes a bore which receives a pin 286 which extends between an aperture in the side wall 42 and an aperture in a downturned shoulder formed in the top panel 40.

The bracket 282, carried by the sleeve 284, is slidable along the pin 286 with its position being controlled by the follower 268. Thus, rotational motion of the follower 268 in response to rotation of the cam 266 will displace the bracket 282 laterally with respect to the longitudinal center line of the inserter.

The bracket 282 further includes a planar base plate 288 with the legs 280 projecting downwardly from opposite sides. A pair of yokes 290, 292 project upwardly from the side of the plate 288 facing the front wall 42 of the chassis. Each yoke includes a pair of spaced apart fingers. From an observation of FIG. 2, it will be noted that the yokes 290, 292, as well as the legs 104, 105 of the bracket follower 96, extend upwardly from beneath the top panel 40 of the chassis through an aperture 294.

Figure 16:
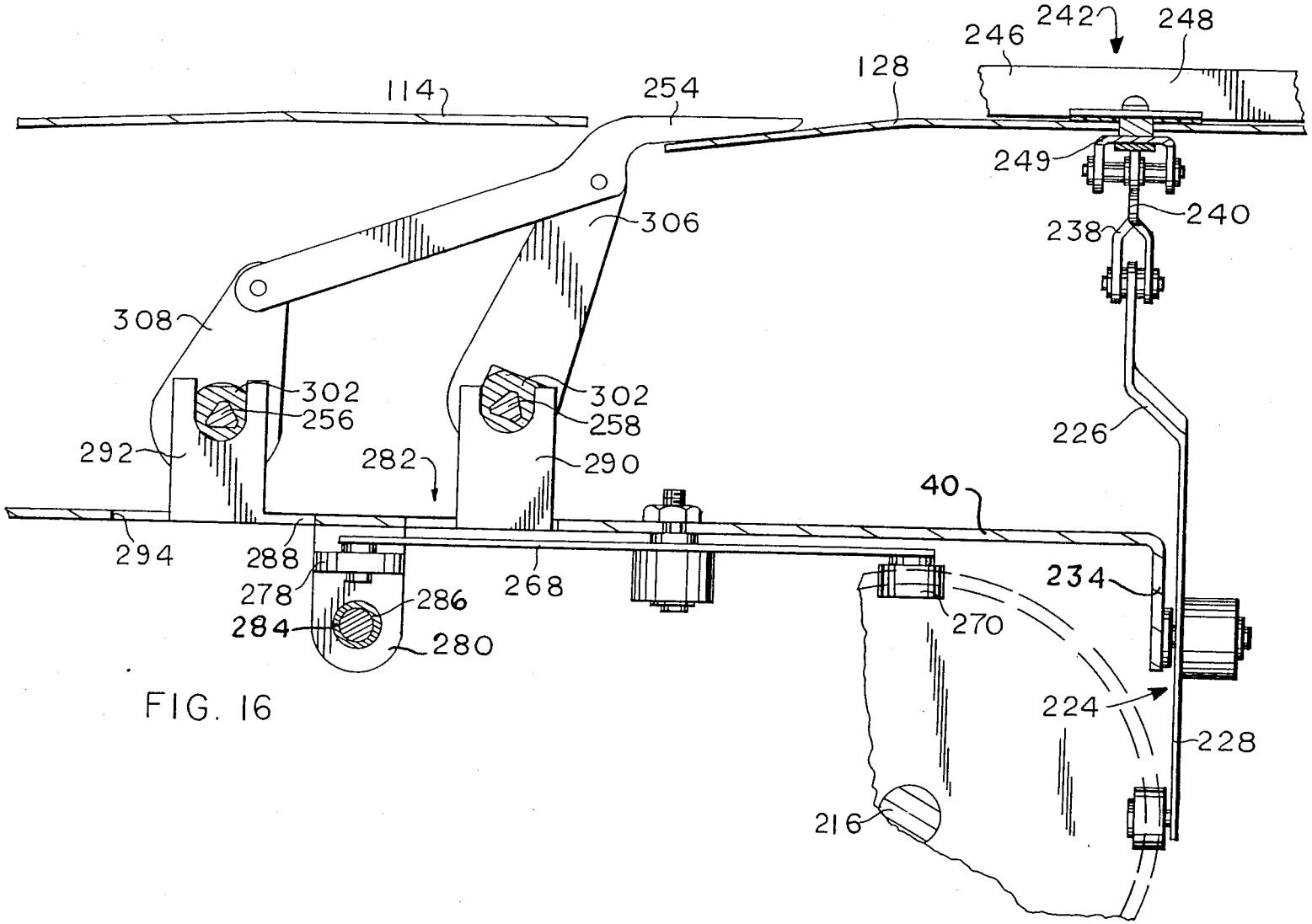
FIG. 16 is a sectional view through the frame and the chassis, the same being taken substantially along the plane 16—16 of FIG. 15 and illustrating a side guide follower and a stripper finger follower and the engagement between a set of yokes driven by the stripper finger follower and a collar slidably mounted to each of a pair of stripper finger shafts; additionally shown is a pair of arms mounted to the collars and carrying an outer stripper finger.
Figure 22:
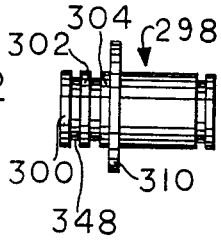
FIG. 22 is a plan view of a typical collar which is slidably mounted over each of the stripper finger shafts and which carries the outer and intermediate stripper finger arms.

Returning now to the stripper finger array, it was previously mentioned that a pair of stripper finger shafts 256, 258 extend between the ribs 260, 262 of the frame casting 35. At the rib 260, the shafts 256, 258 are journalled for rotation within a bushing 296. Inwardly of the rib 260 each shaft 256 258 carries a collar 298 illustrated in FIG. 22. The collar 298 includes an aperture extending through its longitudinal center which is of a configuration adapted to matingly receive the stripper finger shaft 256, 258 for unitary simultaneous rotation therewith. Extending inwardly from the collar end facing the rib 260, the collar includes three spaced radially projecting shoulders 300, 302, 304. The spaced fingers of the yoke 290 engage a reduced diameter groove 348 between the shoulders 300 and 302 as illustrated in FIG. 16. As shown in FIG. 17, the shoulders 300, 302 and 304 are not circular in cross section but bear the configuration of a square having rounded corners.

The outer stripper finger 254 is pivotally mounted to a forward arm 306 and a rear arm 308 as illustrated in FIGS. 16 and 17. The forward arm 306 includes a substantially square aperture which is adapted to be received in tight engagement over the shoulder 304 of the front collar 298, and the rear arm 308 includes a circular aperture adapted to be received over the rounded corners of the shoulder 304 of the rear collar 298. It should be appreciated that when the shaft 258 rotates, it causes the front collar 298 which it carries to rotate. Rotation of the front collar drives the forward arm 306 for unitary rotation and the span of the stripper finger 254 causes the rear arm 308 to pivot in synchronization. The forward and rear arms of the outer stripper finger 254 are maintained in their positions on the shoulders 304 by a radial flange 310 formed in the collar 298 and a retaining clip 312 locked in the reduced diameter groove forward of the shoulder 304.

Rearwardly of the flange 310, the collar 298 extends toward the rib 262 with a smooth cylindrical periphery having a groove for receiving a further retaining clip 312 adjacent its distal end. The intermediate stripper finger 252 is pivotally mounted to a forward arm 314 and a rear arm 316 as illustrated in FIG. 18. Each arm 314, 316 projects radially from an associated hub 318, 320 respectively. The hubs 318, 320 have a cylindrical bore and the cylindrical area of the collar 298 is journalled for rotation within the bores of the hubs 318, 320. The intermediate stripper finger 252 thus moves independently of the stripper finger shafts 256, 258. The intermediate stripper finger hubs 318, 320 extend rearwardly toward the rib 262 and are retained on the cylindrical area of their respective collars 298 between the flange 310 and a clip 312.

Figure 20:
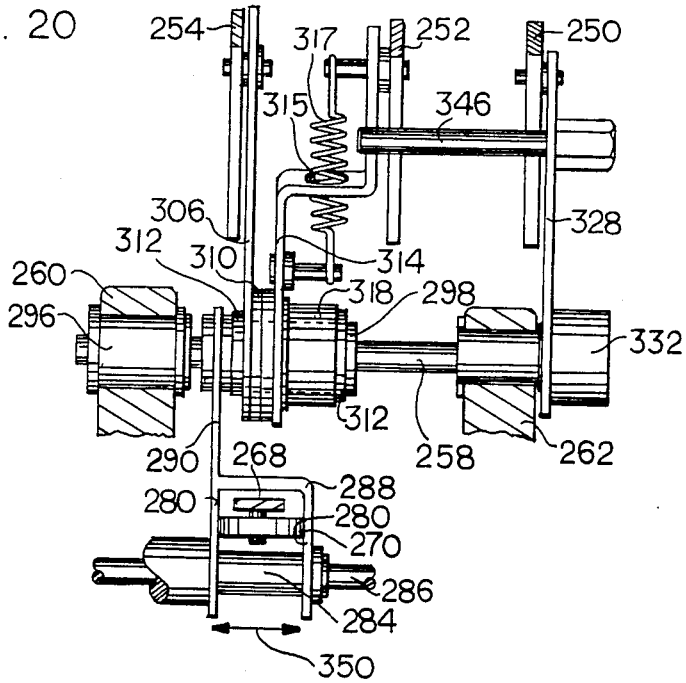
FIG. 20 is a sectional view through the frame casting, the same being taken substantially along the plane 20—20 of FIG. 15 and better illustrating the forward stripper finger arms.

The forward arm 314 includes a horizontal span having an aperture 315 through which a spring 317 extends. As illustrated in FIG. 20, the spring 317 is fixed at one end to a pin projecting from the stripper finger 252 and at its other end to a post projecting from the arm 314. The intermediate stripper finger 252 is spring urged forwardly by a further spring 319 which engages the aperture 315 at one of its ends and is anchored at its other end to the frame casting 35.

The rear arm 316 includes a forwardly projecting horizontal shelf 322 having a threaded bore within which an adjustment stop screw 324 is engaged. The screw 324 includes an enlarged foot which abuts a transverse web 326 extending between the ribs 260, 262. The stop screw 324 is adjusted relative to the shelf 322 to limit the forward rotation of the rear arm 316, hence the forward movement of the intermediate stripper finger 252.

In FIG. 19, the inner stripper finger 250 is illustrated as being pivotally mounted to a forward arm 328 and a rear arm 330. The arms 328, 330 are each fixed to a respective stepped hub 332, 334. The hubs 332, 334 include longitudinal apertures of a configuration mating to that of their respective shafts 256, 258. A reduced diameter cylindrical portion of each hub 232, 234 is journalled for rotation in an aperture formed in the rib 262. The rear arm 330 includes a horizontal shelf 336 having a threaded aperture which receives an adjustable stop screw 338 for limiting the forward position of the arm 330 and the stripper finger 250. An enlarged foot of the screw 338 engages a stop 340 fixed relative to the frame casting 35.

Projecting inwardly from the rear arm 330 is a pin 342 which is engaged by a retractor rod assembly in turn actuated by a ram mechanism of the inserter, all in a manner fully described in the Martin patent. The retractor rod assembly retracts the stripper fingers 250, 252 when the reciprocating ram returns to its home position. The rod pulls the rear arm 330 counterclockwise as viewed from FIG. 19. Such rotation results in the retraction of the stripper finger 250 which is pivotally mounted to the rear arm 330. The interconnection of the rear arm 330 and the forward arm 328 through a span of the stripper finger 250 results in counterclockwise pivotal rotation of the forward arm 328 against the bias of a spring 344 which spans between an aperture in the forward arm 328 and the frame casting 35.

Rotation of the forward arm 328 causes rotation of its hub and the forward stripper finger shaft 258 which is keyed to the hub 332. Rotation of the shaft 258 unitarily rotates the collar 298 carried by the shaft which, in turn, causes the forward arm 306 of the outer stripper finger 254 to rotate in a counterclockwise direction due to the mating configuration of its aperture and the square shoulder 304 of the collar 298. The counterclockwise rotation of the arm 306 in turn causes the stripper finger 254 to move rearwardly which, in turn, causes the rear arm 308 to pivot in a counterclockwise direction.

A horizontal post 346 fixed to and projecting laterally from the forward arm 328 of the inner stripper finger 250 engages the forward arm 314 of the intermediate stripper finger 252 to cause the forward arm 314 to rotate in a counterclockwise direction, thus retracting the intermediate stripper finger 252 and rotating its rear arm 316 in a counterclockwise direction. It should be appreciated that the intermediate stripper finger arms are not fixed to the collars and do not rotate unitarily with their respective stripper finger shafts for reasons set forth in the Martin patent.

Upon the commencement of a forward ram stroke, the retractor rod assembly no longer exerts a rearward force on the pin 342 of the rear arm 330. The biasing force of the spring 344 is therefore sufficient to rotate the forward arm 328 of the inner stripper finger 250 in a clockwise direction as viewed from FIG. 19. Such rotation results in rotation of the shaft 258 and thus drives the outer stripper finger forward arm 306 for simultaneous forward movement of the inner and outer stripper fingers 250, 254. The intermediate stripper finger 252 also moves forwardly under the bias of the spring 319 because the post 346 is no longer in engagement with its forward arm 314.

Pursuant to the present invention, the fingers of the yoke 290 are received within the groove 348 of the collar 298 which carries the forward arms 306, 314 of the outer and intermediate stripper fingers respectively. Similarly, the fingers of the yoke 292 engage the corresponding groove 348 of the collar which carries the rear arms 308, 316 of the outer and intermediate stripper fingers 256, 254 respectively.

Figure 21:
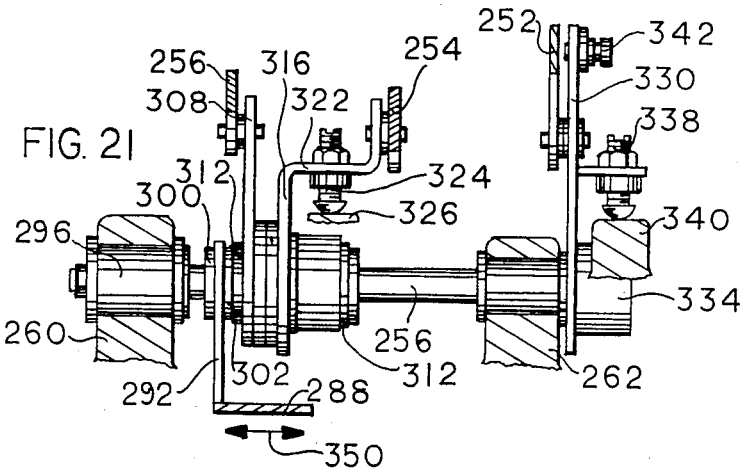
FIG. 21 is a further sectional view through the frame casting, the same being taken substantially along the plane 21—21 of FIG. 15 and similarly illustrating the rearward stripper finger arms.

As previously discussed, the yokes 290, 292 will be simultaneously moved laterally relative to the longitudinal center line of the inserter in response to the rotation of the stripper finger cam 264. Such yoke movement causes corresponding movement of the collars relative to the stripper finger shafts 256, 258 in the directions of the double headed arrow 350 of FIGS. 20 and 21.

A substantially identical stripper finger array is provided on the opposite side of the longitudinal center line of the inserter, adjacent the rear face of the inserter. The intermediate and outer stripper fingers of such array are simultaneously displaced through rotation of the stripper finger cam 266. With regard to the inner stripper finger forward arm 328, in order to utilize the identical arm for such stripper finger array, an aperture 352 (see FIG. 19) is provided adjacent the top of the arm. The aperture 352 is adapted to receive the post 346 in such instance for proper engagement with the forward arm of the intermediate stripper finger.

Pursuant to the invention, the intermediate and outer stripper fingers 252, 254 of each array are positioned at an innermost setting when the inserter 10 is gauged for inserting enclosures into envelopes having a minimum length, e.g. $5\frac{1}{2}$ inches (14 cm.). The envelope side guides 242, 244 are spaced a corresponding distance apart.

Figure 27:
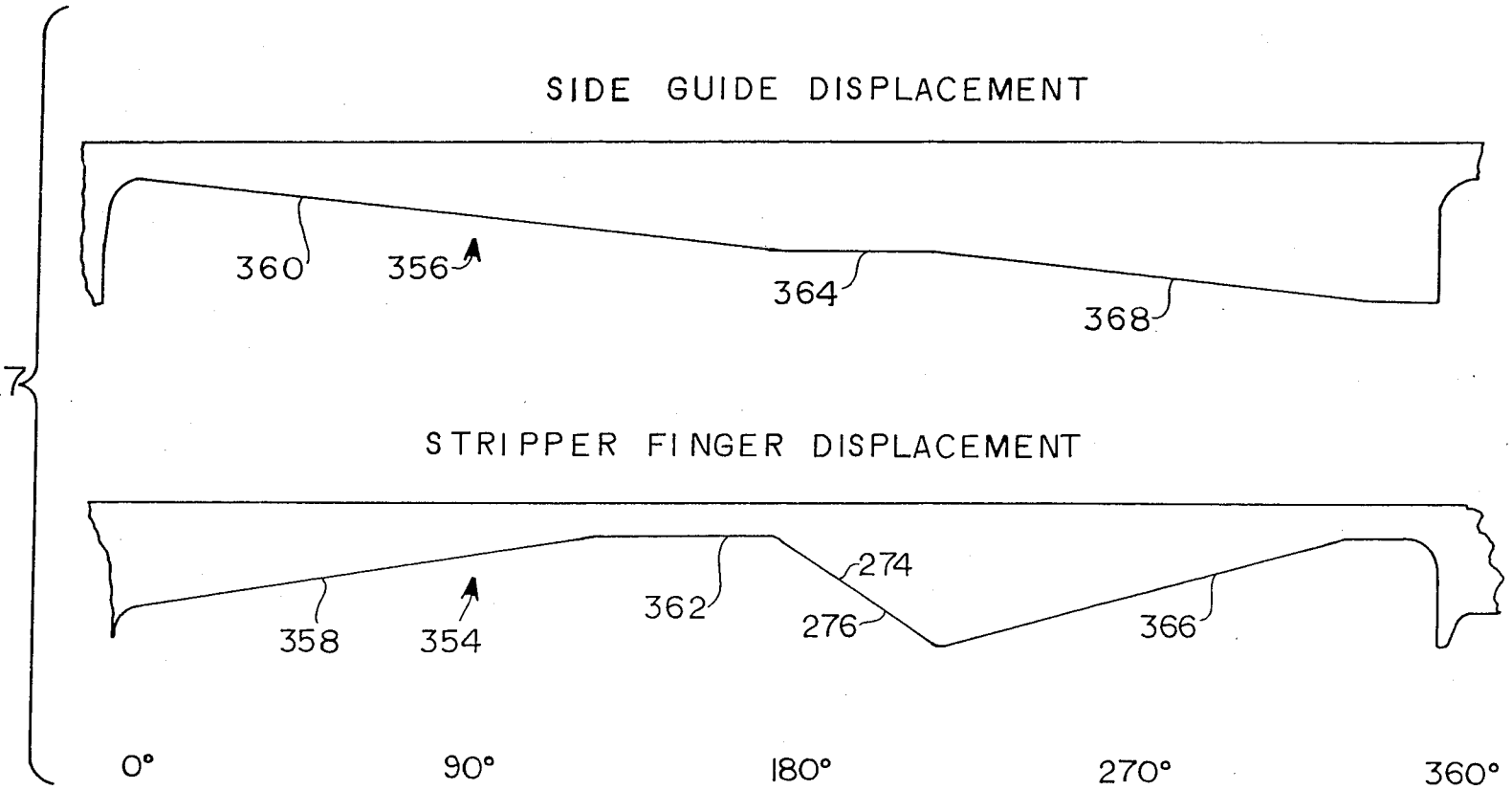
FIG. 27 comprises a pair of cam displacement diagrams for the envelope side guide cams and the stripper finger cams and illustrating a coordinated dwell in side guide movement which coincides with stripper finger retraction.

Referring now to the cam displacement diagrams of FIG. 27, a camming surface 354 of the stripper finger cams 264, 265 and a camming surface 356 of the side guide cams 218, 219 are illustrated as a function of angular rotation. When the knob 196 is rotated to move the pointer 198 away from the index end of the slot 186 to accommodate an envelope longer than the minimum length, the followers engaging the stripper finger cams 264, 266 engage a first sloped zone 358 of the surfaces 354. Simultaneously, the followers 224, 226 engage a first sloped zone 360 of the camming surface 356. Such engagement results in a gradual separation of the envelope side guides 242, 244 and outward movement of the intermediate and outer stripper fingers 252, 254 of each array.

When envelopes are employed within a range of smaller sizes, e.g. between $5\frac{1}{2}$ inches and $8\frac{1}{2}$ inches long (14 cm. through 21.5 cm.), only the inner and intermediate stripper fingers 250, 252 of each array are positioned to enter into an envelope mouth. The outer stripper finger 254 will be spaced beyond the ends of the envelope. If the inserter is gauged for a run of envelopes in a range of larger sizes, e.g. $8\frac{1}{2}$ inches through $9\frac{1}{2}$ inches (21.5 cm. through 24.1 cm.), it is desirable to utilize all of the stripper fingers of each array for opening the throats of envelopes.

For this purpose, after a predetermined degree of rotation of the stripper finger cams, the camming surface 354 includes an unsloped dwell zone 362 which is provided as the gauged envelope length approaches a transition dimension, e.g. $8\frac{1}{2}$ inches (14 cm.). Thereafter, further rotation of the knob 196 results in a retraction of the intermediate and outer stripper fingers of each array to the initial position originally employed for accommodating the smallest size envelope. With the stripper fingers in such position and an envelope of the transition length at the envelope station, all of the stripper fingers of each array will now enter the envelope mouth.

For retracting the intermediate and outer stripper fingers, the camming surface 354 of the stripper finger cams 264, 266 is provided with the steep inclined zone 274, 276 respectively, having a slope opposite that of the first zone 358. When the rollers 270, 272 of the stripper finger followers engage the steep inclined zones 274, 276, rotation of the knob 196 and the cam shaft 216 should not result in increasing the distance between the envelope side guides 242, 244. Accordingly, an unsloped zone 364 is provided in the camming surface 356 of the side guide cams corresponding to the inclined zones 274, 276.

As envelope length increases beyond the transition length the envelope side guides continue to move away from one another and the intermediate and outer stripper fingers of each array move away from the inner stripper finger. The stripper finger camming surface 354 includes a final zone 366 having the same slope as the first zone 358 and the side guide camming surface 356 includes a final zone 368 having the same slope as the first zone 360.

Returning now to FIG. 9 wherein the envelope gauging station 150 is illustrated, it will be seen that rotation of the knob 196 moves the pointer 198 which is fixed to the timing belt 206 and simultaneously drives the cam shaft 216 through the spur gear 204 and the pinion 212.

When the transition length has been reached and the rollers 270, 272 are at the steep zone 274, 276, continued rotation of the knob 196 to accomplish such stripper finger retraction will not result in a simultaneous increase in the spacing between the envelope side guides because the unsloped zones 364 of the side guide cams are in engagement with the side guide followers.

The pointer 198, however, is directly driven through the timing belt 206 and continues to be displaced during the transition. In order to maintain the correspondence between the position of the pointer 198 and the adjusted stripper finger and side guide positions, a displaceable index end 370 is provided for the envelope length slot 194.

Figures 24, 25, 26:
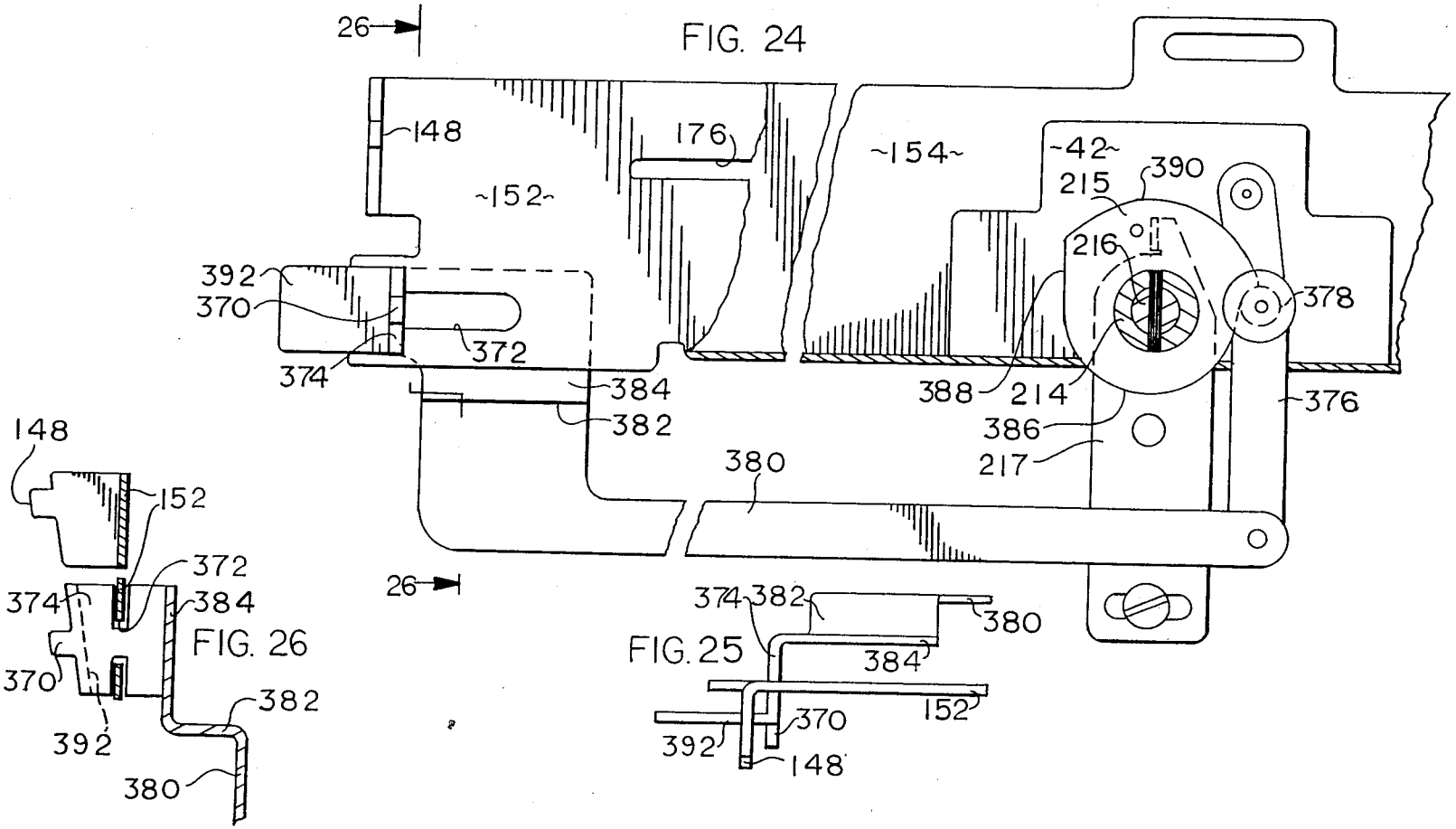
FIG. 24 is a fragmentary sectional view through the envelope gauging station, the same being taken substantially along the stepped plane 24—24 of FIG. 9 and better illustrating the manner in which the index end is displaced.
FIG. 25 is a fragmentary plan view of the envelope gauging station index end and showing the relationship between an adjustment link and a gauging station channel.
FIG. 26 is a sectional view through the envelope gauging station, the same being taken substantially along the plane 26—26 of FIG. 24.

Referring now to the envelope gauging station 150, it will be seen that the front wall 152 includes an open ended slot 372 in registration with and at the same elevation as the pointer 198. The middle span of an H-shaped panel 374 is received within the slot 372 as illustrated in FIG. 26. The displaceable index end 370 projects forwardly from and is unitary with a forward leg of the panel 374.

In accordance with the invention, the panel 374 is displaced within the slot 372 from a position adjacent the free end of the slot to a position adjacent the closed end of the slot simultaneously with the dwell in envelope side guide displacement and retraction of the intermediate and outer stripper finger positions.

The coordinated movement of the index end 370 (toward the right as viewwed in FIG. 24), dwell in side guide displacement and retraction in stripper finger position may take place during angular rotation of the cam shaft 216 between for example, 175° and 220°. Upon rotation of the cam shaft in a reverse direction, the stripper fingers will move to an outer position, the side guides will dwell and the index end 370 will move toward the left.

Referring now to FIG. 24, the cam flange 215 is fixed to the hub 214 which, in turn, is pinned to the cam shaft 216. A follower link 376 is pivoted at its upper end to a post which projects from the chassis side wall 42. Mounted to the follower 376 is a roller 378 which engages a camming periphery of the flange 215. An elongate link 380 is pivotally secured to the lower end of the follower 376. At its opposite end, the link 380 projects upwardly and includes a horizontal forward span 382 and an upward vertical span 384. The H panel 374 projects forwardly from the vertical span 384.

It should be appreciated that the camming surface of the flange 215 includes a first zone 386 of uniform radius which corresponds with the initial 175° of rotation of the cam shaft 216. Thereafter, between 175° and 220° of rotation, a transition zone 388 is provided. A final zone 390 of increased radius is provided from approximately 220° of rotation through the balance of rotation.

With the roller engaging the zone 386 during the initial phase of cam shaft rotation, the index end 370 is maintained in the position shown in FIG. 24. Once the transition zone 388 is reached, further rotation of the cam shaft 216 causes the follower 376 to pivot in a counterclockwise direction which results in movement of the link 380 toward the right. This causes the index end 370 to move toward the right until the roller 378 is engaging the final zone 390. At this juncture, the stripper fingers have retracted and further rotation of the knob 196 will result in coordinated movement of the pointer 198, the stripper fingers and the envelope side guides.

Rotation of the knob 196 in a reverse direction through the transition zone will, of course, result in movement of the index end 370 in a reverse direction. It should be noted that a planar skirt 392 extends rearwardly from the forward leg of the H panel 374. This skirt serves to close the area of the gauging panel slot 194 which is to the left of the index end 370 when the index end 370 is advanced toward the right.

Coordinated displacement of the index end 370 through the cam flange 215 and follower link 376 thus synchronizes the envelope length gauged between the index end 370 and the pointer 198 with the position of the stripper fingers and side guides. Optionally, a suitable camming arrangement could provide a dwell in pointer movement to coincide with the transition zone and thereby employ a fixed index end for the envelope length slot 194.

Thus, it will be seen that there is provided an inserter gauging system which achieves the various objects of the invention and which is well suited to meet the conditions of practical use.

As various changes might be made in the invention as above set forth, it is to be understood that all matter herein described or shown in the accompanying drawings is to be interpreted as illustrative and not in a limiting sense.

Having thus described the invention, there is claimed as new and desired to be secured by Letters Patent:

1. A gauging apparatus for a sheet material handling system having sheet material engaging means, the apparatus comprising: means for receiving a specimen sheet material, the receiving means including means for framing a dimension of the specimen material, and means for positioning the sheet material engaging means as a function of the framing means to accommodate sheet material dimensioned in accordance with the specimen;

(a) wherein the framing means includes a first means for providing an abutment against which an end of the specimen is positioned, pointer means for engaging the opposite end of the specimen and means for adjusting the pointer means, the positioning means including means for positioning the material engaging means as a function of the position of the pointer means;

(b) wherein the means for adjusting the pointer means includes a belt, means mounting the belt in a configuration providing a genrally straight span, means securing the pointer means to the belt at the span and means for driving the belt; and (c) wherein the means for positioning the sheet material engaging means comprises cam means, follower means engaging the cam means, means interconnecting the follower means and the sheet material engaging means and means for rotating the cam means, the rotating means comprising means driven by the belt driving means.

2. A gauging apparatus constructed in accordance with claim 1 wherein the means engaging the sheet material comprises a pair of guides adapted to engage opposite edges of the sheet material.

3. A gauging apparatus constructed in accordance with claim 1 wherein the positioning means includes a second belt, means mounting the second belt in a configuration providing a generally horizontal span, means interconnecting the horizontal span and the sheet material engaging means.

4. A gauging apparatus constructed in accordance with claim 3 wherein the belt drivingly engages the positioning means.

5. A gauging apparatus constructed in accordance with claim 3 wherein the sheet material engaging means comprises stop means for positioning the sheet material at a station.

6. A gauging apparatus constructed in accordance with claim 1 wherein the belt comprises a timing belt and the belt mounting means comprises a plurality of pinions.

7. A gauging apparatus constructed in accordance with claim 1 wherein the first means includes means for displacing the abutment.

8. A gauging aparatus for a sheet material handling system having sheet material engaging means, the apparatus comprising: means for receiving a specimen sheet material, the receiving means including means for framing a dimension of the specimen material, and means for positioning the sheet material engaging means as a function of the framing means to accommodate sheet material dimensioned in accordance with the specimen;

(a) wherein the framing means includes a first means for providing an abutment against which an end of the specimen is positioned, pointer means for engaging the opposite end of the specimen and means for adjusting the pointer means, the positioning means including means for positioning the material engaging means as a function of the position of the pointer means;

(b) wherein the means for adjusting the pointer means includes a belt, means mounting the belt in a configuration providing a generally straight span, means securing the pointer means to the belt at the span and means for driving the belt;

(c) wherein the belt comprises a timing belt and the belt mounting means comprises a plurality of pinions; and (d) including a further sheet material engaging means, the further engaging means comprising a pair of guides adapted to engage opposite edges of envelopes, the positioning means including means for positioning the further engaging means.

9. A gauging apparatus constructed in accordance with claim 8 wherein the positioning means includes a second belt means mounting the second belt in a configuration providing a generally horizontal span, means interconnecting the horizontal span and the sheet material engaging means.

10. A gauging apparatus constructed in accordance with claim 9 wherein the sheet material engaging means comprises stop means for positioning the sheet material at a station.

11. A gauging apparatus constructed in accordance with claim 9 wherein the sheet material engaging means comprises stop means for positioning the sheet material at a station.

12. A gauging apparatus constructed in accordance with claim 8 wherein the first means includes means for displacing the abutment.

* * * * *